US008229330B2

(12) United States Patent
Sakuma

(10) Patent No.: US 8,229,330 B2
(45) Date of Patent: Jul. 24, 2012

(54) DEVELOPING UNIT

(75) Inventor: Susumu Sakuma, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 397 days.

(21) Appl. No.: 12/210,437

(22) Filed: Sep. 15, 2008

(65) Prior Publication Data

US 2009/0087224 A1 Apr. 2, 2009

(30) Foreign Application Priority Data

Oct. 2, 2007 (JP) ..... 2007-258323

(51) Int. Cl.
*G03G 15/08* (2006.01)

(52) U.S. Cl. ..... 399/262; 399/102; 399/103; 399/105; 399/106

(58) Field of Classification Search ..... 399/106
See application file for complete search history.

(56) References Cited

U.S. PATENT DOCUMENTS

| | | | | |
|---|---|---|---|---|
| 6,418,292 | B1 | 7/2002 | Isobe et al. | |
| 6,438,345 | B1 | 8/2002 | Ban et al. | |
| 6,766,133 | B1 * | 7/2004 | Ban et al. | 399/258 |
| 7,450,890 | B2 | 11/2008 | Murakami et al. | |
| 2006/0104671 | A1 | 5/2006 | Murakami et al. | |
| 2008/0124105 | A1 * | 5/2008 | Okamoto et al. | 399/51 |

FOREIGN PATENT DOCUMENTS

| | | | |
|---|---|---|---|
| EP | 1 041 452 | A2 | 10/2000 |
| EP | 1 041 454 | A1 | 10/2000 |
| EP | 1 659 455 | A2 | 5/2006 |
| JP | 09-319202 | | 12/1997 |
| JP | 2005-331617 | A | 12/2005 |
| JP | 2006-163374 | A | 6/2006 |
| JP | 2006-235306 | A | 9/2006 |
| JP | 2007-072234 | A | 3/2007 |

OTHER PUBLICATIONS

JP Office Action dtd Nov. 12, 2009, JP Appln. 2007-258323, partial English translation.
Extended European Search Report date Apr. 4, 2011 in Application No. 08016247.2.

* cited by examiner

*Primary Examiner* — David Gray
*Assistant Examiner* — David Bolduc
(74) *Attorney, Agent, or Firm* — Banner & Witcoff, Ltd.

(57) ABSTRACT

A developing unit includes a developer cartridge for accommodating developer and including a first opening, a first elastic member including a first through hole surrounding the first opening, a housing including a cartridge housing part and a second opening provided in a position opposite to the first opening, a second elastic member including a second through hole surrounding the second opening, and a shutter including a third opening and being movable between an opening position and a closing position. When the shutter is located at the opening position, an upstream end of the third opening in a movement direction of the shutter from the opening position to the closing position is located more upstream than upstream ends of the first through hole and the second through hole in the movement direction.

14 Claims, 16 Drawing Sheets

UPPER SIDE
FRONT SIDE
BACK SIDE
LOWER SIDE
83
89 (47)

UPPER SIDE
FRONT SIDE
LEFT SIDE
RIGHT SIDE
BACK SIDE
LOWER SIDE
83
84
86
87
87
89 (47)
89 (47)
89 (47)
88
81
86
84
87
87

UPPER SIDE
FRONT SIDE
BACK SIDE
LOWER SIDE
83
89 (47)
92
96
92

UPPER SIDE
FRONT SIDE
LEFT SIDE
RIGHT SIDE
BACK SIDE
LOWER SIDE
86
84
87
89 (47)
96
92
83
89 (47)
96
92
81
88
89 (47)
96
92
86
87
84
87

UPPER SIDE
FRONT SIDE
LEFT SIDE
LOWER SIDE
RIGHT SIDE
BACK SIDE
UPPER SIDE
FRONT SIDE
BACK SIDE
LOWER SIDE
81
82
83
84
86
87
89 (47)
92
96
97
98
99
100
101
102 (47)
103
104
107
110
110A (110)
110B (110)
111
31

UPPER SIDE
RIGHT SIDE
FRONT SIDE
LOWER SIDE
BACK SIDE
LEFT SIDE

UPPER SIDE
RIGHT SIDE
FRONT SIDE
LOWER SIDE
BACK SIDE
LEFT SIDE

DEVELOPING UNIT

CROSS-REFERENCE TO RELATED APPLICATIONS

This application claims priority from Japanese Patent Application No. 2007-258323 filed on Oct. 2, 2007, the entire subject matter of which is incorporated herein by reference.

TECHNICAL FIELD

Aspects of the present invention relate to a developing unit of an image forming apparatus.

BACKGROUND

For example, as a developing unit, JP-A-9-319202 discloses a related developing device, in which a developer cartridge accommodating developer is detachably attached to a frame provided with a developing part having a developing roller. In the related art developing device, a hole formed in one side portion of the developer cartridge and a hole formed in the frame form a developer supply opening, and a hole formed in the other side portion of the developer cartridge and a hole formed in the frame form a developer receiving opening.

The developer in the developer cartridge is supplied to the developing part through the developer supply opening, but a part of the developer is returned to the developer cartridge through the developer receiving opening. Accordingly, the developer is circulated between the developing part and the developer cartridge.

SUMMARY

Aspects of the invention provide a developing unit that can allow developer to smoothly move between a developer cartridge and a housing.

According to an aspect of the invention, there is provided a developing unit comprising: a developer cartridge that is configured to accommodate developer and comprises a first opening for enabling communication between an inside of the developer cartridge and an outside of the developer cartridge; a first elastic member that comprises a first through hole and protrudes outward from the developer cartridge, the first through hole surrounding the first opening; a housing comprising: a cartridge housing part for housing the developer cartridge; and a second opening that is provided in a position opposite to the first opening and is formed toward the cartridge housing part; a second elastic member which protrudes from the housing toward the cartridge housing part, which is contactable with the first elastic member, and which comprises a second through hole surrounding the second opening; and a shutter that comprises a third opening and is movable between an opening position where the third opening is located at a position between the first opening and the second opening and a closing position where the third opening gets apart from the position between the first opening and the second opening, wherein when the shutter is located at the opening position, an upstream end of the third opening in a movement direction of the shutter from the opening position to the closing position is located more upstream than upstream ends of the first through hole and the second through hole in the movement direction.

According to the aspect of the invention, when the shutter is located at the opening position in a state where the developer cartridge is housed in the cartridge housing part of the housing, the first opening of the developer cartridge and the second opening of the housing communicate with each other through the third opening of the shutter interposed therebetween. Accordingly, the developer accommodated in the developer cartridge can move between the developer cartridge and the housing (for example, a developing part having a developing roller) through the first opening, the second opening, and the third opening. In contrast, when the shutter is located at the closing position, the third opening gets apart from the position between the first opening and the second opening. Accordingly, the first opening and the second opening do not communicate with each other and thus the movement of the developer between the developer cartridge and the housing (developing part) can be regulated.

The second elastic member on a side surface of the housing is in contact with the first elastic member close to the developer cartridge, and the space between the first opening and the second opening is surrounded with the first through hole of the first elastic member and the second through hole of the second elastic member without any gap. Accordingly, it is possible to prevent the developer from leaking between the first opening and the second opening.

Here, when the shutter is located at the opening position, the upstream end of the third opening of the shutter is disposed more upstream than the upstream ends of the first through hole and the second through hole in the movement direction (simply referred to as "movement direction" in the following description) of the shutter from the opening position to the closing position. Accordingly, since the upstream end of the third opening of the shutter can be made to depart from the flow of developer moving between the first opening and the second opening, the upstream end does not hinder the flow of developer, thereby allowing the developer to smoothly move between the developer cartridge and the housing (developing part).

BRIEF DESCRIPTION OF THE DRAWINGS

FIG. 11A shows a first aspect thereof and FIG. 11B shows a second aspect thereof;

DETAILED DESCRIPTION

In the related developing device, it can be considered to provide seal members in the frame and the developer cartridge so as to surround the holes forming the developer supply opening and the developer receiving opening. By bringing the seal members of the frame and the corresponding seal members of the developer cartridge into contact with each other, gaps between the frame and the developer cartridge around the developer supply opening and the developer receiving opening can be sealed. The developer passes through spaces surrounded with the seal members in the developer supply opening and the developer receiving opening and thus moves between the developing part and the developer cartridge without any leakage.

Further, it can be considered to provide a shutter for opening and shutting the developer supply opening and the developer receiving opening between the frame and the developer cartridge. Through holes corresponding to the developer supply opening and the developer receiving opening are formed in the shutter. Here, when the corresponding through hole of the shutter is disposed between the holes forming the developer supply opening in the frame and the developer cartridge, the developer supply opening is opened. In contrast, when the shutter moves to bring the through hole apart from the position between the holes, the developer supply opening is closed. The developer receiving opening is also opened and closed in the same way as the developer supply opening. By allowing the shutter to close the developer supply opening and the developer receiving opening, the leakage of developer from the developer supply opening and the developer receiving opening is prevented when the developer cartridge is attached to and detached from the frame.

When the shutter is provided, circumferential edge portions of the through holes of the shutter may protrude into the spaces surrounded with the seal members in the developer supply opening and the developer receiving opening. In this case, due to the hindrance of the circumferential edge portions, the developer may not smoothly move between the developing part and the developer cartridge through the developer supply opening and the developer receiving opening.

Aspects of the invention provide a developing unit that can allow a developer to smoothly move between a developer cartridge and a housing.

Exemplary embodiments of the present invention will be described with reference to the drawings.

(Image Forming Apparatus)

Figure 1:
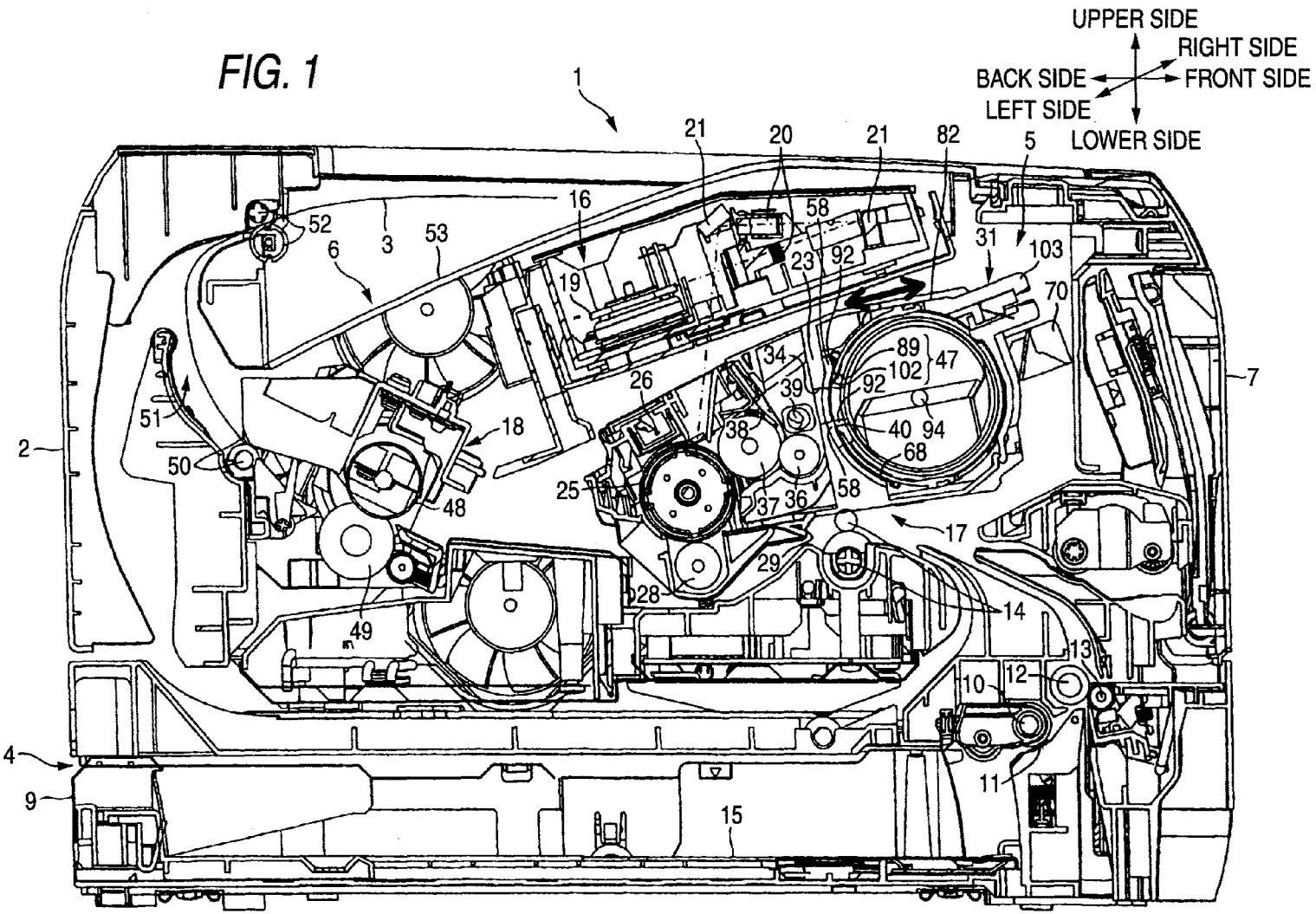
FIG. 1 is a left side sectional view showing an image forming apparatus according to the invention.

Referring to FIG. 1, an image forming apparatus 1 includes a feeder unit 4 feeding a sheet 3 to a body casing 2, an image forming unit 5 forming an image on the fed sheet 3, and a sheet discharge unit 6 discharging the sheet 3 having an image formed thereon.

(1) Body Casing

The body casing 2 has a box shape, where an opening is formed in one side wall and a front cover 7 opening and closing the opening is provided. By opening the front cover 7, a process cartridge 17 (which will be described later) as an example of the developing unit is attachable to and detachable from the body casing 2 in the direction indicated by a bold line.

In the following description, it is assumed that a side provided with the front cover 7 is a front side (front surface side) and the opposite side is a rear side (rear surface side). The front side in the paper thickness direction of FIG. 1 is a left side and the depth side in the paper thickness direction of FIG. 1 is a right side. The lateral direction is equal to the width direction. The horizontal direction includes the front-rear direction and the lateral direction and the vertical direction includes the up-down direction. In describing the process cartridge 17 to be described later and a developer cartridge 31 as an example of the developer cartridge, it is based on a state where a frame-side passage hole 34 (which will be described later) as an example of the second opening and a cartridge-side passage hole 47 (which will be described later) are opposed to each other substantially in the horizontal direction (front-rear direction).

(2) Feeder Unit

The feeder unit 4 includes a sheet feed tray 9, a feed roller 10, a feed pad 11, paper dust removing rollers 12 and 13, a registration roller 14, and a sheet pressing plate 15. The sheet 3 located at the uppermost of the sheet pressing plate 15 is sent to the feed roller 10 and the feed pad 11 sheet by sheet, passes through the rollers 12 to 14, and then is conveyed to a transfer position (which will be described later) of the image forming unit 5.

(3) Image Forming Unit

The image forming unit 5 includes a scanner unit 16, a process cartridge 17, and a fixing part 18.

(3-1) Scanner Unit

The scanner unit 16 is disposed in an upper portion of the body casing 2 and includes a laser emitting part (not shown), a polygon mirror 19 rotationally driven, plural lenses 20, and plural reflecting mirrors 21. As indicated by a one-dot chained line, a laser beam emitted from the laser emitting part based on image data is reflected by the polygon mirror 19, is transmitted or reflected by the plural lenses 20 and the plural reflecting mirrors 21, and is applied to the surface of a photosensitive drum 25 (which will be described later) of the process cartridge 17.

(3-2) Process Cartridge

The process cartridge 17 is housed in a space below the scanner unit 16 in the body casing 2 and is detachably attached to the body casing 2.

Figures 2A, 2B:
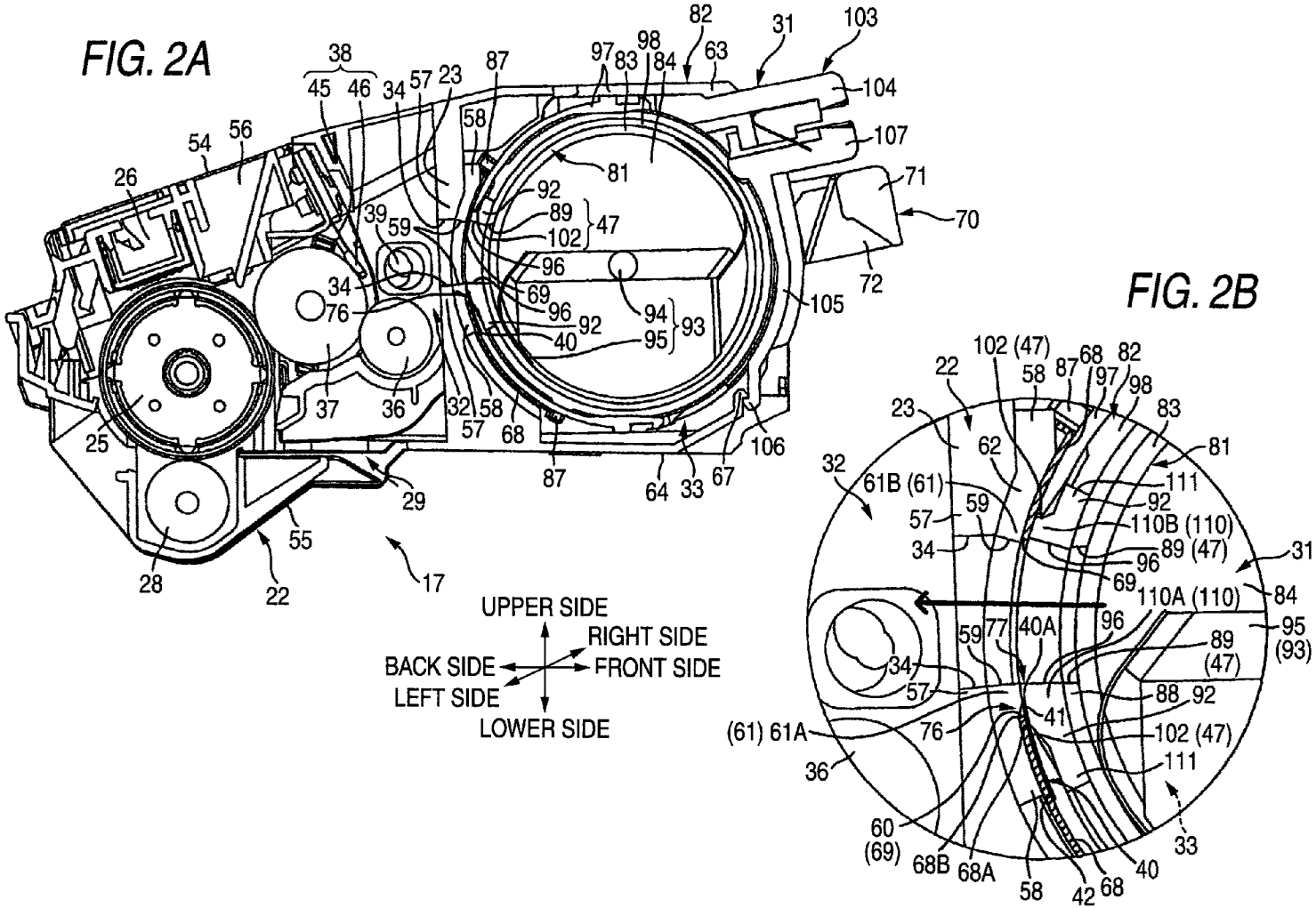
FIG. 2A is a left side sectional view of a process cartridge of the image forming apparatus, showing a state where a developer cartridge is attached and a swing arm is located at a pressing position.
FIG. 2B is a partial enlarged view of FIG. 2A.

As shown in FIGS. 2A and 2B, the process cartridge 17 includes a hollow process frame 22 having a transfer path 29 allowing the passage of the sheet 3 and a developer cartridge 31 detachably attached to a cartridge holding part 33 (which will be described later) of the process frame 22. The process frame 22 serves as an example of the housing.

Substantially at the center position in the front-rear direction of the process frame 22, a partition wall 23 extending in the vertical direction is disposed. In the inside space of the process frame 22, the rear side of the partition wall 23 serves as a developing part 32 and the front side of the partition wall 23 serves as the cartridge holding part 33. A frame-side passage hole 34 is formed in the partition wall 23. The developing part 32 and the cartridge holding part 33 communicate with each other through the frame-side passage hole 34.

A photosensitive drum 25, a scorotron-type charger 26, a transfer roller 28, a supply roller 36, a developing roller 37, a thickness regulating blade 38, and an auger 39 are disposed in the developing part 32. The photosensitive drum 25, the transfer roller 28, the supply roller 36, the developing roller 37, and the auger 39 are rotatably supported by the process frame 22.

The scorotron-type charger 26 is supported above the photosensitive drum 25 by the process frame 22 with a gap from the photosensitive drum 25. The transfer roller 28 is oppositely disposed below the photosensitive drum 25. The developing roller 37 is oppositely disposed in front of the photosensitive drum 25. The supply roller 36 is oppositely disposed in front of the developing roller 37. The thickness regulating blade 38 includes a thin-plate leaf spring member 45 of which the upper end is fixed to the process frame 22 and a pressing rubber 46 disposed at the lower end of the leaf spring member 45 to press the surface of the developing roller 37 with an elastic force of the leaf spring member 45. The auger 39 includes a shaft extending in the width direction and a spiral blade formed on the outer circumferential surface of the shaft and is disposed above the supply roller 36 and in back of the frame-side passage hole 34.

The developer cartridge 31 is detachably attached to the process frame 22 and is held in the cartridge holding part 33 at the time of attaching. The developer cartridge 31 has a substantially cylindrical shape. A cartridge-side passage hole 47 allowing the inside to communicate with the outside is formed in the developer cartridge 31.

An agitator 93 is rotatably disposed in the developer cartridge 31. A positively chargeable, non-magnetic one component toner as an example of the developer is accommodated in the developer cartridge 31.

The developer in the developer cartridge 31 is agitated with the rotation of the agitator 93 and is supplied into the developing part 32 from the cartridge-side passage hole 47 through the frame-side passage hole 34. Thereafter, the developer is conveyed in the width direction by the rotating auger 39, drops in the middle way, and is supplied to the supply roller 36.

Then, the developer supplied to the supply roller 36 is supplied to the developing roller 37 with the rotation of the supply roller 36. At this time, the developer is positively charged between the supply roller 36 and the developing roller 37. Subsequently, the developer supplied to the developing roller 37 enters between the pressing rubber 46 and the developing roller 37 with the rotation of the developing roller 37, is regulated in thickness therebetween, and is held as a thin layer on the surface of the developing roller 37.

The surface of the photosensitive drum 25 is first positively and uniformly charged by the scorotron-type charger 26 with the rotation of the photosensitive drum 25 and then is exposed by the laser beam from the scanner unit 16. Accordingly, an electrostatic latent image based on image data is formed on the surface of the photosensitive drum 25. Then, with the rotation of the developing roller 37, the developer held on the surface of the developing roller 37 is supplied to the electrostatic latent image formed on the surface of the photosensitive drum 25 at the time of coming in contact with the photosensitive drum 25. Accordingly, the electrostatic latent image is developed (visualized) and a developer image is held on the surface of the photosensitive drum 25. The developer image is transferred onto the sheet 3 passing between the photosensitive drum 25 and the transfer roller 28 (transfer position) in the transfer path 29.

(3-3) Fixing Part

The fixing part 18 is disposed in back of the process cartridge 17 as shown in FIG. 1. The fixing part 18 includes a heating roller 48, a pressurizing roller 49 pressed against the heating roller 48 from the downside, and a pair of conveyance rollers 50 disposed in the back thereof.

The fixing part 18 thermally fixes the developer transferred onto the sheet 3 at the transfer position while the sheet 3 passes between the heating roller 48 and the pressurizing roller 49. Thereafter, the sheet 3 is conveyed to a sheet discharge part 6 by the pair of conveyance rollers 50.

(4) Sheet Discharge Part

The sheet discharge part 6 includes a discharge path 51, a discharge roller 52, and a sheet discharge tray 53. The sheet 3 fed from the fixing part 18 to the sheet discharge part 6 is fed from the discharge path 51 to the discharge roller 52 and is discharged onto the sheet discharge tray 53 by the discharge roller 52.

(Process Cartridge)

Figures 3A, 3B:
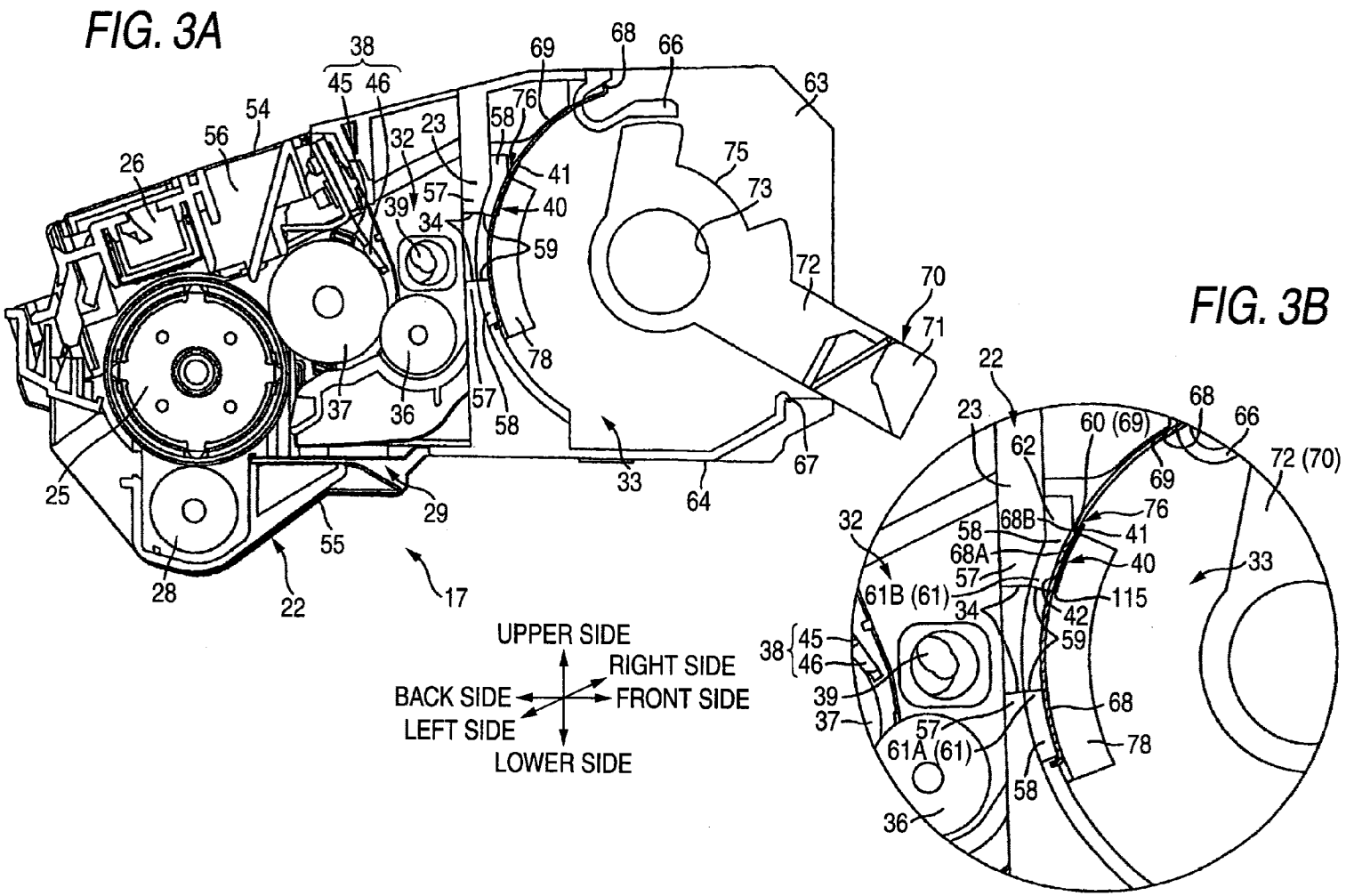
FIG. 3A is a left side sectional view of the process cartridge, showing a state where the developer cartridge is detached and the swing arm is located at a press releasing position.
FIG. 3B is a partial enlarged view of FIG. 3A.
Figure 4:
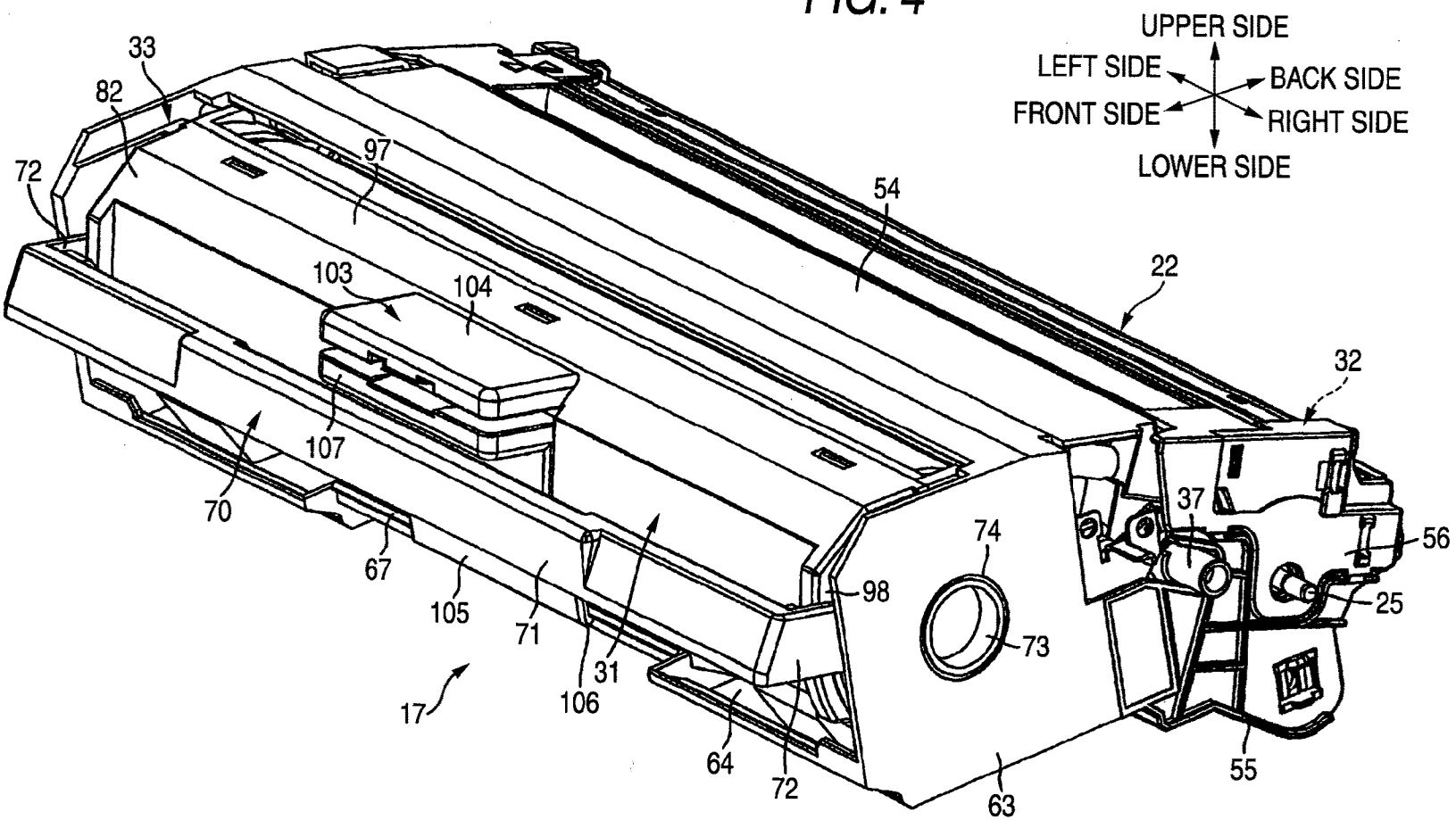
FIG. 4 is a perspective view of the process cartridge shown in FIGS. 2A and 2B as viewed obliquely from a front-right side.
Figure 5:
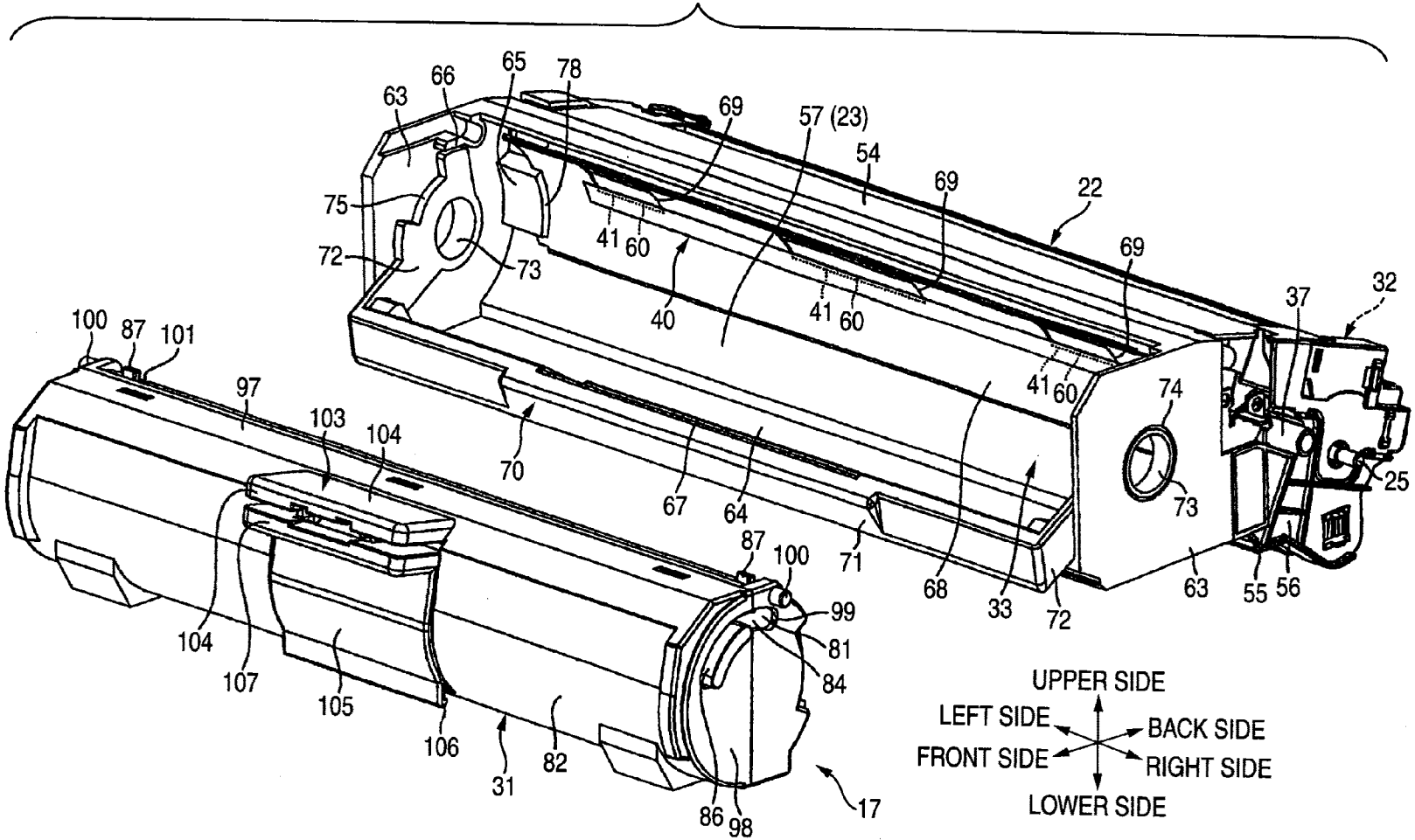
FIG. 5 is an exploded perspective view of the process cartridge as viewed obliquely from the front-right side.
Figure 6:
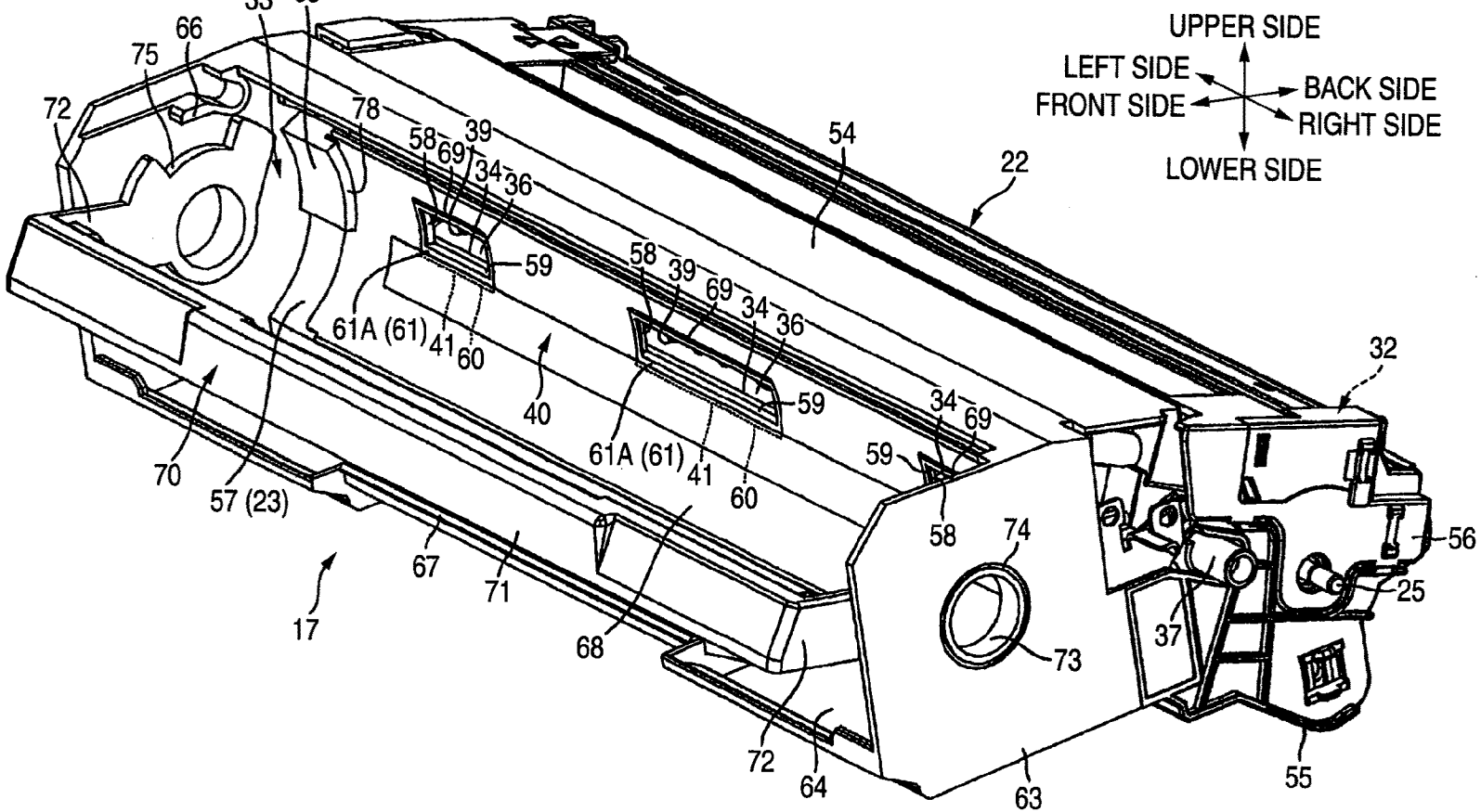
FIG. 6 is a diagram showing a state where the process cartridge is omitted from FIG. 4.

FIG. 3A a left side sectional view showing a process cartridge (in a state where the developer cartridge is detached and the swing arm is located at the press releasing position) of the image forming apparatus shown in FIG. 1, and FIG. 3B is a partial enlarged view of FIG. 3A. FIG. 4 is a perspective view of the process cartridge shown in FIG. 2A as viewed obliquely from the front right side. FIG. 5 is an exploded perspective view of the process cartridge as viewed obliquely from the front right side. FIG. 6 is a perspective view in which the process cartridge is omitted from FIG. 4.

(1) Process Frame

As shown in FIGS. 3A and 3B, the developing part 32 and the cartridge holding part 33 are formed in the process frame 22.

(1-1) Developing Part

As shown in FIGS. 3A, 3B and 4, the developing part 32 is a space by a top wall 54, a bottom wall 55, both side walls 56, and the partition wall 23. Both side walls 56 extend in the front-rear direction and are disposed opposite to each other with a gap therebetween in the width direction.

As shown in FIGS. 2A and 2B, a curved portion 57 is formed in the middle way in the vertical direction of the partition wall 23. The front side surface of the curved portion 57 is smoothly depressed backward along the outer circumferential surface of the developer cartridge 31. The frame-side passage hole 34 is formed in the curved portion 57. As shown in FIG. 6, three frame-side passage holes 34 are formed with a gap in the width direction. The frame-side passage holes 34 have substantially rectangular shapes longitudinal in the width direction and face the cartridge holding part 33.

As shown in FIGS. 3A and 3B, a frame seal 58 for preventing the leakage of the developer from the frame-side passage hole 34 to the cartridge holding part 33 is bonded to the front side surface of the curved portion 57. The frame seal 58 serves as an example of the capturing member and the second seal. The frame seal 58 is formed a band shape extending in the width direction out of an elastic foamed material. Three cutout portions 59 are formed with a gap in the width direction to correspond to the frame-side passage holes 34. The cutout portion 59 serves as an example of a second passage hole. The cutout portions 59 are through holes having substantially the same size as the corresponding frame-side passage holes 34 and communicate with the corresponding frame-side passage holes 34 from the front side. In this state, the frame seal 58 is disposed around the frame-side passage holes 34 so that the cutout portions 59 surround the corresponding frame-side passage holes 34, and protrudes into the cartridge holding part 33.

(1-2) Cartridge Holding Part

As shown in FIG. 5, the cartridge holding part 33 is a space defined by both side plates 63, a bottom plate 64, and the partition wall 23. Both side plates 63 extend continuous from both side walls 56 of the developing part 32 and the bottom plate 64 extends continuous from the bottom wall 55 of the developing part 32.

Shutter supporting portions 65 are disposed on the inner side surface in the width direction of both side plates 63. The shutter supporting portions 65 have a rectangular parallelepiped shape having an arc-like section as viewed in the width direction and protrude inward from the inner side surface in the width direction of both side plates 63.

A shutter guide portion 78 is disposed on the inner side surface in the width direction of the shutter supporting portion 65. The shutter guide portion 78 forms a convex claw protruding inward from the inner side surface of the shutter supporting portion 65 and is opposed to the curved portion 57 of the partition wall 23 with a slight gap in the front-rear direction. The shutter guide portion 78 has a curved shape having substantially the same curvature as the curved portion 57.

Upper fixing portions 66 are disposed in the inner side surface in the width direction of both side plates 63. The upper fixing portions 66 have substantially a U shape depressed obliquely to the rear downside as viewed in the width direction and protrude inward from the inner side surface in the width direction of both side plates 63. A lower fixing portion 67 protruding slightly forward is formed at the center in the width direction of the front end of the bottom plate 64 (see FIG. 3A).

A shutter 68 opening and closing the frame-side passage holes 34 is disposed in the cartridge holding part 33.

The shutter 68 has a substantially rectangular plate shape extending in the width direction and has a curved shape having substantially the same curvature as the curved portion 57 of the partition wall 23. The shutter 68 extends between the shutter guide portions 78 in the width direction and extends longer than the shutter guide portions 78 in the vertical direction. Three shutter openings 69 are formed in the shutter 68 to oppositely correspond to the frame-side passage holes 34 with a gap in the width direction. The shutter opening 69 functions as a third opening.

As shown in FIGS. 3A and 3B, the shutter 68 is opposed to the curved portion 57 to which the frame seals 58 are bonded from the front side, and both ends thereof in the width direction are interposed between the curved portion 57 and the shutter guide portions 78 so as to be slidable.

Accordingly, the shutter 68 is supported to freely swing in the vertical direction along the shutter guide portions 78 between an opening position (see FIGS. 2A and 2B) where the frame-side passage holes 34 are opened and a closing position (see FIGS. 3A, 3B and 5) where the frame-side passage holes 34 are closed. The position of the shutter 68 when the shutter 68 located at the opening position is made to move upward by a predetermined distance is the closing position.

As shown in FIGS. 2A and 2B, when the shutter 68 is located at the opening position, the frame-side passage holes 34 and the cutout portions 59 are opposed to the corresponding shutter openings 69 to communicate therewith and are opened to the outside (front side). At this time, as shown in FIG. 2B, inner circumferential edge portions 61 of the frame seals 58 defining the cutout portions 59 are exposed from the corresponding shutter openings 69 to the front side. Particularly, a lower inner circumferential edge portion (referred to as a lower circumferential edge portion 61A) of each inner circumferential edge portion 61 below the cutout portions 59 protrudes to the front side so that the front side surface thereof is substantially flush with the front side surface of the shutter 68. In contrast, an upper portion (referred to as upper circumferential edge portion 61B) of each inner circumferential edge portion 61 above the corresponding cutout portion 59 is slightly exposed from the shutter opening 69, but most thereof is pressed on the shutter 68 (a portion of the shutter 68 above the shutter opening 69). A portion (a portion more apart from the corresponding cutout portion 59 than the inner circumferential edge 61) of each frame seal 58 other than the corresponding inner circumferential edge portion 61 is compressed between the curved portion 57 of the partition wall 23 and the shutter 68 so as to surround the space between the corresponding frame-side passage hole 34 and the corresponding shutter opening 69. Accordingly, the developer is prevented from leaking from the frame-side passage holes 34 and the shutter openings 69 communicating with each other to the gap between the curved portion 57 and the shutter 68.

When the shutter 68 is located at the closing position, as shown in FIGS. 3A and 3B, the frame-side passage holes 34 and the cutout portions 59 are closed from the front side by the portion of the shutter 68 below the shutter openings 69.

Here, as shown in FIG. 5, the front side surface of the shutter 68 is provided with a sheet 40. The sheet 40 is a rectangular sheet longitudinal in the width direction and being formed of a flexible member (such as a PET film, a rubber, or a thin metal plate). The size of the sheet 40 in the width direction is greater than a distance between the left end of the left shutter opening 69 and the right end of the right shutter opening 69.

Sheets 40 are disposed to extend continuously from the lower end portions of all the shutter openings 69 in the shutter 68, and a part (referred to as a damming portion 41) of each upper end portion of the sheets 40 protrudes upward into the shutter opening 69. Specifically, the damming portions 41 of the sheets 40 are located at the same positions as the corresponding shutter openings 69, and as shown in FIG. 2B, cover the lower end portions 60 of the corresponding shutter openings 69 from the front side (from the cartridge housing part 33 side). Here, the lower end portions 60 are upstream end portions of the shutter openings 69 in the movement direction of the shutter 68 from the opening position to the closing position. The upside in the vertical direction is downstream (that is, the movement direction is upward) in the movement direction of the shutter 68 from the opening position to the closing position, and the downside is upstream in the movement direction of the shutter 68 from the opening position to the closing position. Rear side surfaces (referred to as bonding surfaces 42) of portions below the damming portions 41 of the sheets 40 are bonded from front side surfaces of portions below the shutter openings 69 of the shutter 68.

The bonding surfaces 42 of the sheet 40 are bonded to the front side surface of the shutter 68 so that the damming portions 41 protrude from the downside in the shutter openings 69. Here, the protruding distance of the damming portions 41 into the shutter openings 69 is set to, for example, 0.5 mm (at most 1.0 mm). Accordingly, the damming portions 41 protrude more upward than the portions (referred to as lower edges 68A) defining the lower end portions 60 of the shutter openings 69 in the shutter 68. That is, when the damming portions 41 and the lower edges 68A of the shutter 68 are all referred to as a protruding portion 76, the protruding portion 76 is disposed at the lower end portions 60 of the shutter openings 69 of the shutter 68. In the protruding portion 76, the front ends (damming portions 41) protrude more upward than the rear ends (lower edges 68A). As shown in FIGS. 3A and 3B, an angle between the protruding direction of the damming portions 41 and the horizontal surface when the shutter 68 is located at the closing position is, for example, 40° upward.

As shown in FIG. 5, the cartridge holding part 33 is provided with a swing arm 70. The swing arm 70 has substantially a U shape in a plan view. The swing arm 70 monolithically includes a grip rod 71 extending in the width direction and arm side plates 72 extending from both end portions of the grip rod 71 in the width direction to the rear side.

Bosses 73 protruding outward in the width direction are disposed in the rear end portions of the arm side plates 72. The bosses 73 are rotatably supported by round holes 74 formed in the corresponding side plates 63.

A receiving concave portion 75 cut depressed downward is formed at upper ends of the rear end portions of the arm side plates 72.

The swing arm 70 swings about the bosses 73 of the arm side plates 72 between a press releasing position (see FIGS. 3A, 3B and 5) where the lower ends of the arm side plates 72 come in contact with the front end of the bottom plate 64 and a pressing position (see FIGS. 2A, 2B, 4 and 6) where the developer cartridge 31 is pressed from the front side when the developer cartridge 31 is held in the cartridge holding part 33.

(2) Developer Cartridge

Figures 7A, 7B:
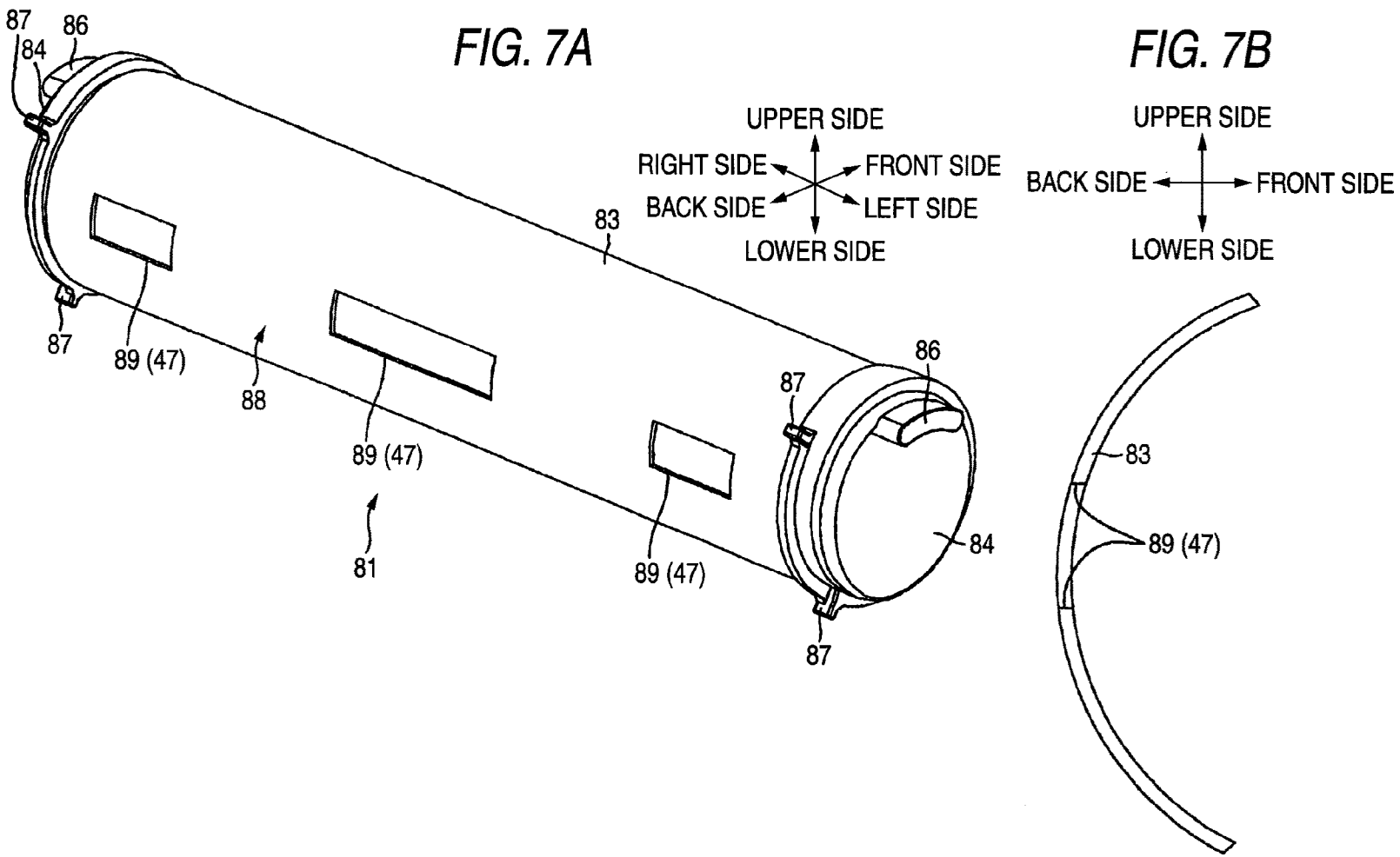
FIG. 7A is a perspective view of an inside housing of the developer cartridge as obliquely viewed from a rear left side, showing a state where a developer seal is not bonded.
FIG. 7B is a partial sectional view of the inside housing shown in FIG. 7A around an inside passage hole.
Figures 8A, 8B:
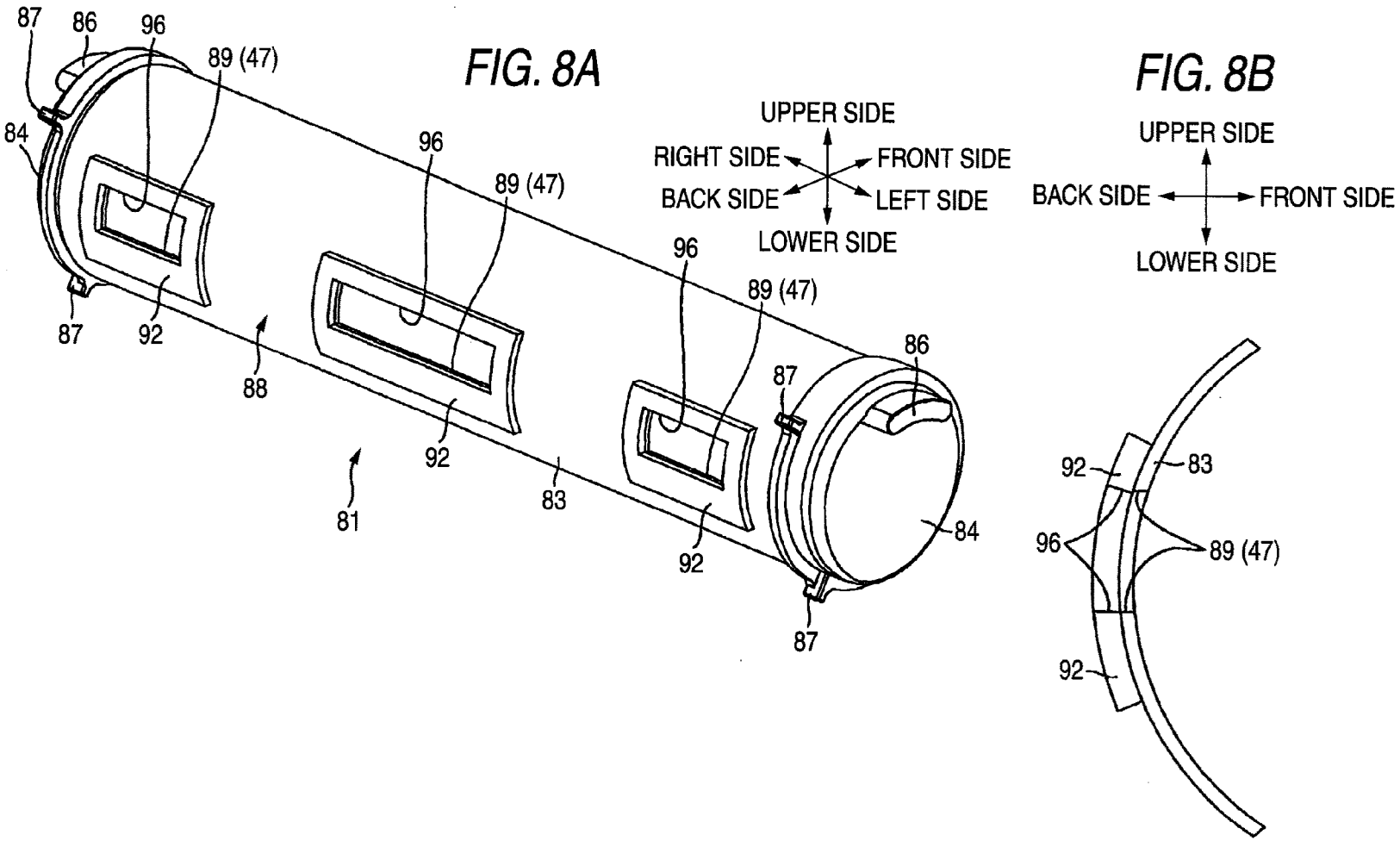
FIG. 8A is a diagram showing a state where the developer seal is bonded in FIG. 7A.
FIG. 8B is a diagram showing a state where the developer seal is bonded in FIG. 7B.
Figures 9A, 9B:
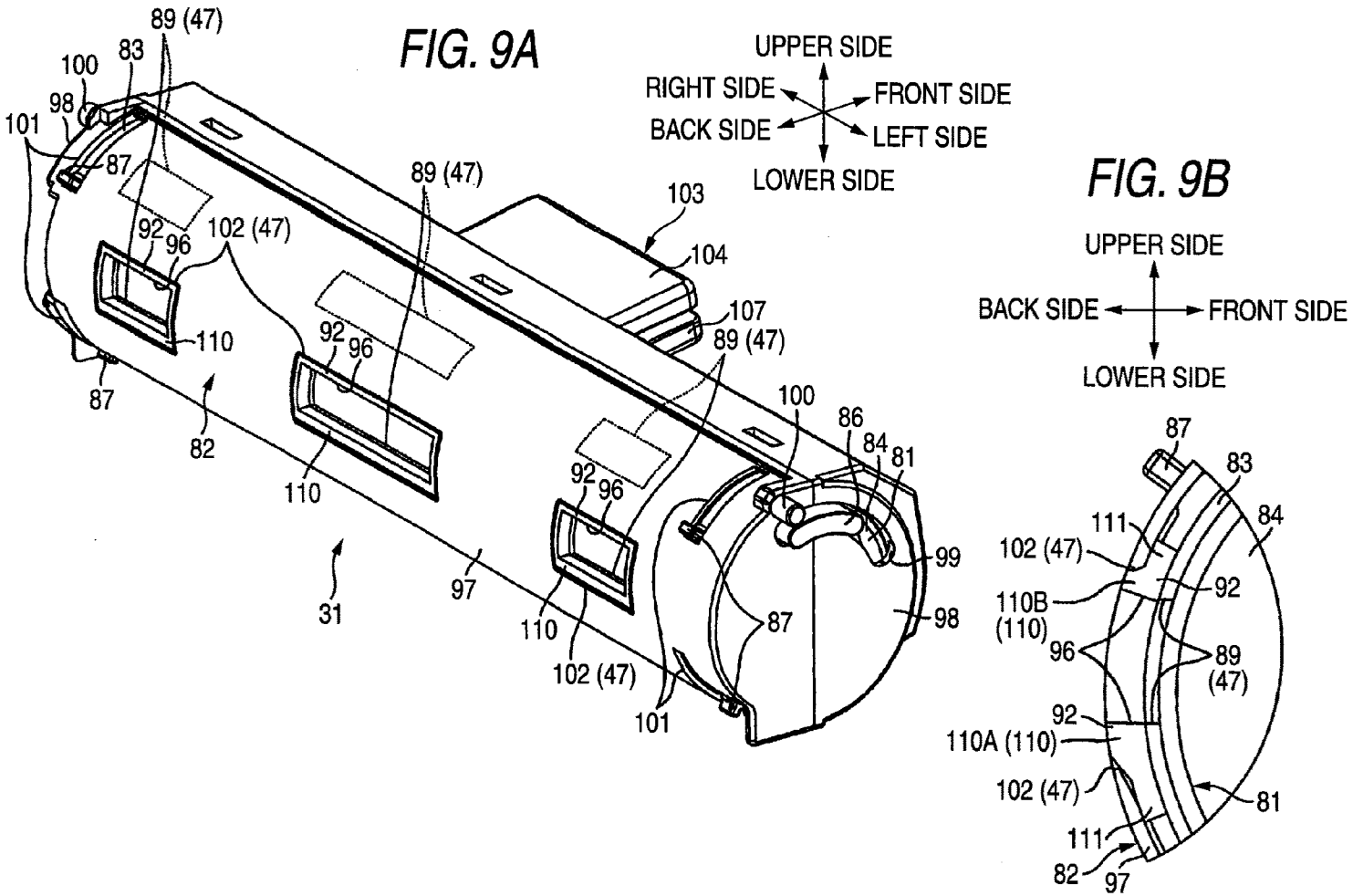
FIG. 9A is a perspective view of the developer cartridge as obliquely viewed from the rear left side, showing a state where the inside housing is located at a first opening position.
FIG. 9B is a partial sectional view of the developer cartridge shown in FIG. 9A around a cartridge-side passage hole.

FIG. 7A is a perspective view showing an inside housing (before a developer seal is bonded thereto) of the developer cartridge as obliquely viewed from the back left side. FIG. 7B is a partial side sectional view of an inside passage hole of the inside housing shown in FIG. 7A. FIG. 8A shows a state where the developer seal is bonded in FIG. 7A. FIG. 8B shows a state where the developer seal is bonded in FIG. 7B. FIG. 9A is a perspective view of the developer cartridge (a state where the inside housing is located at an opening position) as viewed obliquely from the rear left side and FIG. 9B is a partial sectional view of the developer cartridge shown in FIG. 9A around a cartridge-side passage hole.

As shown in FIGS. 7A to 9B, the developer cartridge 31 includes an inside housing 81 accommodating the developer and an outside housing 82 housing the inside housing 81.

(2-1) Inside Housing

As shown in FIG. 7A, the inside housing 81 monolithically includes a cylindrical inside circumferential wall 83 extending in the width direction and a pair of disk-like inside side walls 84 closing both end portions in the width direction of the inside circumferential wall 83. In the following description, as long as it is not particularly mentioned, it is based on a state where inside passage holes 89 to be described later face the rear side.

A slide protrusion 86 is disposed at one position (upper end portion in FIG. 7A) on the circumferential edge of the inside side wall 84. The slide protrusion 86 has a circular arc shape along the outer circumferential surface of the inside side wall 84 in a side view and protrudes outward in the width direction from the inside side wall 84.

A pair of interposing protrusions 87 protruding in the diameter direction from the circumferential end surface is disposed in the backside portion of the inside side wall 84. The pair of interposing protrusions 87 is disposed in the circumferential end surface of the inside side wall 84 with a gap in the circumferential direction (a gap corresponding to a circumferential length of the shutter 68).

In the inside circumferential wall 83, inside passage holes 89 forming a part of the cartridge-side passage holes 47 are formed in a surrounding portion 88 surrounded with a pair of interposing protrusions 87 (four interposing protrusions 87) disposed on both sides in the width direction.

Each inside passage hole 89 has a substantially rectangular shape longitudinal in the width direction as viewed from the rear side. Specifically, three inside passage holes are formed to correspond to three frame-side passage holes 34 (see FIG. 6) with gaps in the width direction. At the time of forming an image, the inside passage holes 89 are opposed to the frame-side passage holes 34 (see FIG. 6) and the cutout portions 59 (see FIG. 6) located at the corresponding positions in the width direction.

As shown in FIGS. 8A and 8B, three developer seals 92 for preventing the developer from leaking from the inside passage holes 89 are bonded to the surrounding portion 88 to correspond to the inside passage holes 89. The developer seals 92 are an example of the first elastic member. Each developer seal 92 is formed of an elastic material such as urethane sponge and has a band shape having a length (thickness) homogeneous in the front-rear direction. In the developer seals 92, cutout portions 96 penetrating the developer seals 92 in the front-rear direction are formed at positions slightly deviated upward from the center position as viewed from the rear side so as to correspond to the inside passage holes 89. The cutout portions 96 are an example of the first through hole. Each cutout portion 96 has a substantially rectangular shape having substantially the same size as the corresponding inside passage hole 89 as viewed from the rear side, and is opposed to the corresponding inside passage hole 89. In this way, the developer seals 92 protrude outward in the diameter direction so that the cutout portions 96 surround the inside passage holes 89, respectively.

As shown in FIG. 2A, the inside housing 81 is provided with the agitator 93. The agitator 93 includes an agitator shaft 94 extending in the width direction and agitation blades 95 extending outward in the diameter direction from the agitator shaft 94. The agitator shaft 94 is rotatably supported by both inside side walls 84 and rotates with a driving force from a motor (not shown) at the time of forming an image.

(2-2) Outside Housing

The outside housing 82 is slightly greater in the width direction and the diameter direction than the inside housing 81 so as to rotatably house the inside housing 81. As shown in FIG. 9A, the outside housing 82 monolithically includes a substantially cylindrical outside circumferential wall 97 extending in the width direction and a pair of outside side walls 98 closing both end portions in the width direction of the outside circumferential wall 97 and having substantially a disk shape. In the following description, as long as not particularly mentioned, a state where the outside passage holes 102 face the rear side is used as a reference.

The outer circumferential surfaces of the upper portion and the front upper portion of the outside circumferential wall 97 have a flat shape, but the inner circumferential surface of the outer circumferential surface 97 has a circular section (see FIGS. 2A and 2B).

Slide holes 99 into which the slide protrusions 86 are inserted are formed in the upper portions of the outside side walls 98. The slide holes 99 are disposed to face the slide protrusions 86 in the width direction. The slide holes 99 have a circular arc shape longer than the slide protrusions 86 in the side view. The upper end portions of the outside side walls 98 are provided with a boss 100 protruding outward in the width direction. Four longitudinal holes 101 into which a pair of interposing protrusions 87 (four interposing protrusions 87) are inserted are formed in both end portions in the width direction of the outside circumferential wall 97. The longitudinal holes 101 are disposed to face the interposing protrusions 87 in the diameter direction. The longitudinal holes 101 has a substantially rectangular shape vertically extending in the rear view and have a length corresponding to a swing range between the opening position and the closing position of the shutter 68.

In the outside circumferential wall 97, outside passage holes 102 forming a part of the cartridge-side passage holes 47 are formed between four longitudinal holes 101 (between two upper longitudinal holes 101 and two lower longitudinal holes 101).

Three outside passage holes 102 are formed with a gap in the width direction to correspond to three inside passage holes 89 and the frame-side passage holes 34 (see FIG. 6). The outside passage holes 102 have substantially a rectangular shape greater than the corresponding inside passage holes 89 as viewed from the rear side. At the time of forming an image, the outside passage holes 102 are opposed to the inside passage holes 89, the cutout portions 96 of the developer seals 92, the frame-side passage holes 34 (see FIG. 6), the cutout portions 59 (see FIG. 6) of the frame seals 58, and the shutter openings 69 (see FIG. 6) of the shutter 68, which are located at the corresponding positions in the width direction.

A grasp portion 103 is disposed in front of the outside circumferential wall 97. As shown in FIG. 2A, the grasp portion 103 includes an upper grasp plate 104 protruding forward from the upper end portion of the outside circumferential wall 97 and a locking arm 105 having substantially a J shape extending downward in the side view below the upper grasp plate 104. The upper end portion of the locking arm 105 is pivotably supported by a supporting pivot (not shown) disposed below the upper grasp plate 104. A locking claw 106 locked to a lower fixing portion 67 is disposed in the lower end portion of the locking arm 105. A lower grasp plate 107 protruding forward is monolithically disposed in the vicinity of the upper end portion of the locking arm 105. The lower grasp plate 107 is disposed parallel to the upper grasp plate 104 with a gap therebetween and a compression spring (not shown) urging the plates in the direction in which they get apart from each other is interposed between the upper grasp plate 104 and the lower grasp plate 107.

(2-3) Relative Arrangement of Inside Housing and Outside Housing

The inside housing 81 is rotatably housed in the outside housing 82.

Specifically, the outer circumferential surface of the inside circumferential wall 83 is disposed to be slidable relative to the inner circumferential surface of the outside circumferential wall 97 in the circumferential direction. More specifically, the developer seals 92 disposed in the outer circumferential surface of the inside circumferential wall 83 come in contact with the inner circumferential surface of the outside circumferential wall 97, and the developer seals 92 slides relative to the inner circumferential surface of the outside circumferential wall 97. As shown in FIG. 9A, the slide protrusions 86 are inserted into the slide holes 99. The interposing protrusions 87 are inserted into the longitudinal holes 101 and the interposing protrusions 87 protrude outward in the diameter direction from the longitudinal holes 101.

The inside housing 81 is allowed to rotate relative to the outside housing 82 between a closing position (see FIG. 5) where the inside passage holes 89 and the cutout portions 96 of the developer seals 92 are not opposed to the outside passage holes 102 and an opening position (see FIGS. 2A, 2B, 9A and 9B) where the inside passage holes 89 and the cutout portions 96 are opposed to the outside passage holes 102.

As shown in FIG. 5, when the inside housing 81 is located at the closing position, the slide protrusions 86 are disposed at the upper ends of the longitudinal holes 101, respectively. As indicated by a dotted line in FIG. 9A, the inside passage holes 89 are disposed above the outside passage holes 102 and thus the outside passage holes 102 are closed from the inside in the diameter direction by portions below the inside passage holes 89 (indicated by dotted lines) in the inside circumferential wall 83.

Here, although not shown, the developer seals 92 are compressed between the inside circumferential wall 83 and the outside circumferential wall 97 shown in FIG. 9B.

When the inside housing 81 is made to rotate relative to the outside housing 82 in the direction (downward) in which the inside passage holes 89 face the outside passage holes 102 and thus the inside passage holes 89 and the cutout portions 96 are opposed to the outside passage holes 102, the inside housing 81 is located at the opening position.

When the inside housing 81 is located at the opening position, as shown in FIG. 9A, the slide protrusions 86 are located in the rear end portions of the slide holes 99, and the interposing protrusions 87 are located in the lower end portions of the longitudinal holes 101. The inside passage holes 89 and the cutout portions 96 are opposed to the corresponding outside passage holes 102 and they communicate with each other.

In the state where the inside housing 81 is located at the opening position, the inside edges 110 defining the cutout portions 96 in the developer seals 92 are exposed from the corresponding outside passage holes 102. Specifically, as shown in FIG. 9B, the inside edges 110 protrude outward in the diameter direction so that the outside surface in the diameter direction is flush with the outside surface of the outside circumferential wall 97. The portions (being more apart from the cutout portions 96 than the inside edges 110 and being referred to as outside edges 111) of the developer seals 92 other than the inside edges 110 are compressed between the outside circumferential wall 97 and the inside circumferential wall 83 so as to surround the corresponding inside passage holes 89. Accordingly, the developer is prevented from leaking from the inside passage holes 89 and the outside passage holes 102 communicating with each other to the gap between the outside circumferential wall 97 and the inside circumferential wall 83.

(3) Attachment and Detachment of Developer Cartridge to and from Process Frame (3-1) Attachment of Developer Cartridge to Process Frame When it is intended to attach the developer cartridge 31 to the process frame 22, as shown in FIG. 5, the upper grasp plate 104 and the lower grasp plate 107 are pressed against the urging force of the compression spring (not shown) in a direction in which both plates get close to each other. Then, the developer cartridge 31 (the developer cartridge 31 in which the inside housing 81 is located at the closing position) is attached to the cartridge holding part 33 (the cartridge holding part 33 in which the shutter 68 is located at the closing position and the swing arm 70 is located at the press releasing position).

Accordingly, the developer cartridge 31 is placed on the bottom plate 64. At this time, the bosses 100 are received in the upper locking portions 66, the slide protrusions 86 are inserted into the receiving concave portions 75, and the pair of interposing protrusions 87 on both sides in the width direction interposes the upper end and the lower end on both sides in the width direction of the shutter 68, as shown in FIG. 2A.

Thereafter, when the upper grasp plate 104 and the lower grasp plate 107 are released freely, the locking arm 105 swings with the urging force of the compression spring and the locking claws 106 are locked to the lower fixing portions 67, whereby the developer cartridge 31 is housed in the cartridge housing part 33.

The outside housing 82 is fixed to the cartridge housing part 33, since the bosses 100 are received in the upper locking portions 66 and the locking claws 106 are locked to the lower fixing portions 67. At this time, although not shown, the frame-side passage holes 34 and the corresponding cartridge-side passage holes 47 (specifically, the outside passage holes 102) are opposed to each other in the front-rear direction with the shutter 68 at the closing position interposed therebetween. That is, in the shutter 68, the front side is close to the cartridge-side passage holes 47 (cartridge housing part 33) and the rear side is close to the frame-side passage holes 34 (more apart from the cartridge housing part 33 than the front side). The shutter openings 69 (see FIGS. 3A and 3B) of the shutter 68 located at the closing position are apart upward from the positions between the frame-side passage holes 34 and the cartridge-side passage holes 47 (specifically, the outside passage holes 102).

Then, the swing arm 70 is made to swing from the press releasing position to the pressing position. Accordingly, the slide protrusions 86 inserted into the receiving concave portions 75 (see FIG. 5) slide backward in the slide holes 99 with the swing of the arm side plates 72 and are located in the rear end portions of the slide holes 99 (see FIG. 9A). Accordingly, the pair of interposing protrusions 87 on both sides in the width direction slide downward in the longitudinal holes 101 with the shutter 68 interposed therebetween and are located in the lower end portions of the longitudinal holes 101 (see FIG. 9A).

Accordingly, the inside housing 81 is located at the opening position and as shown in FIGS. 2A, 9A and 9B, the inside passage holes 89 and the cutout portions 96 of the developer seals 92 are opposed to the outside passage holes 102, respectively, substantially in the horizontal direction, whereby they are made to communicate with each other. The shutter 68 is located at the opening position, and the frame-side passage holes 34 and the cutout portions 59 of the frame seals 58 are opposed to the corresponding shutter openings 69 and the corresponding cartridge-side passage holes 47 (including the inside passage holes 89, the cutout portions 96, and the outside passage holes 102 communicating with each other) substantially in the horizontal direction, whereby they are made to communicate with each other. Here, the shutter openings 69 of the shutter 68 located at the opening position are disposed between the frame-side passage holes 34 and the cartridge-side passage holes 47.

As shown in FIG. 2B, when both the inside housing 81 and the shutter 68 are located at the opening position, the inner circumferential edges 110 of the developer seals 92 protruding to the outside in the diameter direction of the outside circumferential wall 97 protrude to the rear side so as to surround the corresponding shutter openings 69. Specifically, in the inner circumferential edges 110, the inner circumferential edges (referred to as lower circumferential edges 110A) below the cutout portions 96 are pressed on the lower circumferential edges 61A below the cutout portions 59 of the frame seals 58. In the inner circumferential edges 110 of the developer seals 92, the inner circumferential edges (referred to as upper circumferential edges 110B) above the cutout portions 96 are pressed on the shutter 68 (portions of the shutter 68 above the shutter openings 69). Here, the portions of the shutter 68 above the shutter openings 69 are disposed between the portions (the upper circumferential edges 61B) of the frame seals 58 above the cutout portions 59 and the portions (the upper circumferential edges 110B) of the developer seals 92 above the cutout portions 96.

In this way, since the spaces between the inside passage holes 89 and the frame-side passage holes 34 are covered with the frame seals 58, the developer seals 92 and the shutter 68 without any gap, the developer is prevented from leaking between the inside passage holes 89 and the frame-side passage holes 34.

Between the lower circumferential edges of the inside passage holes 89 and the lower circumferential edges of the frame-side passage holes 34, a flat surface 77 along the horizontal direction is formed continuous by the lower edges 61A of the frame seals 58 and the lower edges 110A of the developer seals 92. Here, the protruding portions 76 (the lower edges 68A of the shutter 68 and the damming portions 41 of the sheet 40) are disposed below the flat surface 77 (the lower ends of the inside passage holes 89 and the lower ends of the frame-side passage holes 34).

That is, the upper ends 40A (also upper ends of the damming portions 41) of the sheet 40 and the upper ends 68B (lower ends of the shutter openings 69 of the shutter 68) of the lower edges 68A of the shutter 68 are not exposed from the cutout portions 59 of the frame seals 58 and the cutout portions 96 of the developer seals 92 and are disposed below the lower ends of the cutout portions.

At the time of forming an image, the developer in the inside housing 81 is supplied to the developing part 32 with the agitation of the agitator 93 through the inside passage holes 89, the cutout portions 96 of the developer seals 92, the outside passage holes 102, the shutter openings 69, the cutout portions 59 of the frame seals 58, and the frame-side passage holes 34 in the horizontal direction, as indicated by a solid arrow in the drawings. At this time, the developer moves over the flat surface 77. The developer may be made to circulate between the developing part 32 and the developer cartridge 31. In this case, the developer in the developer cartridge 31 is supplied into the developing part through the cartridge-side passage hole 47 (see FIG. 9A) and the frame-side passage hole 34 (see FIG. 6) located at the center in the width direction, and is supplied to the supply roller 36 while being conveyed to both sides in the width direction by the auger 39. In contrast, some developer is returned to the developer cartridge 31 through the frame-side passage holes 34 and the cartridge-side passage holes 47 located at both sides in the width direction.

(3-2) Detachment of Developer Cartridge from Process Frame

When it is intended to detach the developer cartridge 31 from the process frame 22, first, the swing arm 70 is made to swing from the pressing position to the press releasing position (see FIG. 3A).

By allowing the swing arm 70 to swing from the pressing position to the press releasing position, the slide protrusions 86 inserted into the receiving concave portions 75 slide forward in the slide holes 99 with the swing of the arm side plates 72 and are located in the front end portions of the slide holes 99, as shown in FIG. 5. Then, the pair of interposing protrusions 87 on both sides in the width direction shown in FIGS. 2A and 2B slide upward in the longitudinal holes 101 with the shutter 68 interposed therebetween and are located in the upper end portions of the longitudinal holes 101 (see FIG. 5).

Accordingly, in the developer cartridge 31, the inside housing 81 is located at the closing position and the lower portion of the surrounding portion 88 (see FIG. 8A) is opposed to the outside passage holes 102, thereby closing the outside passage holes 102. In addition, the shutter 68 is located at the closing position, and the frame-side passage holes 34 and the cutout portions 59 of the frame seals 58 are opposed to the shutter 68 and are thus closed (see FIGS. 3A and 3B).

Then, by grasping the upper grasp plate 104 and the lower grasp plate 107 shown in FIG. 2A in the direction in which they get close to each other, the locking claws 106 are unlocked from the lower fixing portions 67. Accordingly, as shown in FIG. 5, when the developer cartridge 31 is drawn forward from the cartridge housing part 33, the developer cartridge 31 is detached from the process frame 22.

In the process cartridge 17, as shown in FIGS. 2A and 2B, when the developer cartridge 31 is housed in the cartridge housing part 33 and the shutter 68 is located at the opening position, the cartridge-side passage holes 47 of the developer cartridge 31 and the frame-side passage holes 34 of the process frame 22 are opposed to each other with the shutter openings 69 interposed therebetween to communicate with each other. Specifically, the cartridge-side passage holes 47, the frame-side passage holes 34, and the shutter openings 69 are arranged in the horizontal direction. Accordingly, the developer accommodated in the developer cartridge 31 can move between the developer cartridge 31 and the process frame 22 (specifically, the developing part 32) through the cartridge-side passage holes 47, the frame-side passage holes 34 and the shutter openings 69. The frame seals 58 of the process frame 22 are in contact with the developer seals 92 of the developer cartridge 31 and the spaces between the cartridge-side passage holes 47 and the frame-side passage holes 34 are surrounded with the cutout portions 96 of the developer seals 92 and the cutout portions 59 of the frame seals 58 without any gap, respectively. Accordingly, it is possible to prevent the developer from leaking between the cartridge-side passage holes 47 and the frame-side passage holes 34.

In contrast, when the shutter 68 is located at the closing position, the shutter openings 69 get apart from the positions between the cartridge-side passage holes 47 and the frame-side passage holes 34. Accordingly, the cartridge-side passage holes 47 and the frame-side passage holes 34 do not communicate with each other, thereby regulating the movement of the developer between the developer cartridge 31 and the process frame 22 (see FIGS. 2A to 3B).

Here, when the shutter 68 is made to move upward from the opening position to the closing position, it can be considered that the developer being moving between the developer cartridge 31 and the process frame 22 may be attached to the lower end portions 60 (specifically, the upper end 68B of the shutter 68) of the shutter openings 69. In this case, when the developer cartridge 31 is detached from the process frame 22 with the shutter 68 located at the closing position (see FIGS. 3A and 3B), the developer attached to the upper end 68B may overflow the cartridge housing part 33 and fly to the outside.

However, the protruding portions 76 are disposed in the lower end portions 60. In the protruding portions 76, the front ends (damming portions 41) close to the cartridge-side passage holes 47 (close to the cartridge housing part 33) protrude upward more than the rear ends (the lower circumferential edges 68A) close to the frame-side passage holes 34 (more apart from the cartridge housing part 33 than the cartridge-side passage holes 47). Accordingly, even when the developer is attached to the lower end portions 60 of the shutter openings 69, the developer is blocked from the cartridge-side passage holes 47 side by the protruding portions 76, thereby preventing the developer from overflowing the cartridge housing part 33 and flying to the outside.

When the shutter 68 is located at the opening position, the protruding portions 76 are located below the lower ends of the cartridge-side passage holes 47 and the frame-side passage holes 34. Accordingly, the protruding portions 76 can be made to depart from the flow of developer (indicated by the solid arrow in FIG. 2B) moving between the cartridge-side passage holes 47 and the frame-side passage holes 34. Accordingly, the protruding portions 76 do not hinder the flow of developer, thereby allowing the developer to smoothly move between the developer cartridge 31 and the process frame 22 (the developing part 32). Since the lower end portions 60 of the shutter openings 69 are also made to depart from the flow of developer moving between the cartridge-side passage holes 47 and the frame-side passage holes 34 along with the protruding portions 76, it is possible to prevent the developer from being attached to the lower end portions 60.

Here, when the shutter 68 is located at the opening position, the upper ends 68B of the lower circumferential edges 68A of the shutter openings 69 in the shutter 68 are disposed below the lower ends of the cutout portions 96 of the developer seals 92 and the cutout portions 59 of the frame seals 58. Accordingly, since the upper end 68B of the shutter 68 can be made to depart from the flow of developer moving between the cartridge-side passage holes 47 and the frame-side passage holes 34, the upper end 68B does not hinder the flow of developer, thereby allowing the developer to smoothly move between the developer cartridge 31 and the process frame 22 (the developing part 32).

Since the lower end portions 60 (specifically, the lower circumferential edge 68A of the shutter 68) of the shutter openings 69 are located below the bonding portions between the lower circumferential edges 61A of the frame seals 58 and the lower circumferential edges 110A of the developer seals 92, the lower end portions 60 do not hinder the flow of developer moving between the cartridge-side passage holes 47 and the frame-side passage holes 34. Accordingly, it is possible to prevent the developer from being attached to the lower end portions 60 when the shutter 68 is located at the opening position.

As shown in FIGS. 3A and 3B, since the sheets 40 included in the protruding portions 76 protrude into the shutter openings 69 in the front of the shutter 68 to block the developer attached to the lower end portions 60 of the shutter openings 69 from the front side, it is possible to block the developer attached to the lower end portions 60 of the shutter openings 69 from the front side, thereby preventing the developer from overflowing the cartridge housing part 33 to fly.

The sheets 40 are flexible. Accordingly, even when the shutter 68 has a curved shape, the sheets 40 can be closely attached to the shutter 68. As a result, the sheets 40 can block the developer attached to the lower end portions 60 of the shutter openings 69 from the front side without any gap.

Then, by bonding the bonding surfaces 42 of the sheets 40 to the portions of the shutter 68 below the shutter openings 69, it is possible to easily bond the sheets 40 to the shutter 68.

Here, when the sheets 40 have the same color as the developer, the developer attached to the lower end portions 60 of the shutter openings 69 can be made to be invisible. In contrast, when the sheets 40 have a color different from that of the developer, the developer attached to the lower end portions 60 of the shutter openings 69 can be made to be visible, thereby urging a user to clean the lower end portions 60 or preventing the user from coming in contact with the developer attached to the lower end portions 60 to contaminate his or her hand.

MODIFIED EXEMPLARY EMBODIMENTS

(1) First Modification to the Exemplary Embodiments

In the above-described exemplary embodiments, as shown in FIG. 1, the process cartridge 17 monolithically has the photosensitive drum 25 and the developing roller 37, and the process cartridge 17 is detachably attached to the body casing 2. In addition, for example, the process cartridge 17 may be formed by a developing cartridge not having the photosensitive drum 25 and a particular unit (drum cartridge) having the photosensitive drum 25 may be provided, where the developing cartridge may be detachably attached to the drum cartridge. The process cartridge 17 may be attached to the body casing 2 and only the developer cartridge 31 may be detachable.

The body casing 2 may be provided with the photosensitive drum 25, the scorotron-type charger 26 and the transfer roller 28, and the developing cartridge may be detachably attached to the body casing 2. Here, the developer cartridge 31 is attachable to and detachable from the developing cartridge, and the shutter 68 is disposed in the developing cartridge.

(2) Second Modification to the Exemplary Embodiments

Although exemplary embodiments of the inventive concept have been described in relation to a laser printer, the present inventive concept is not limited to a monochrome laser printer. Rather, the present inventive concept can also be applied to a color laser printer, including a tandem type and an intermediate transfer type printer.

(3) Third Modification to the Exemplary Embodiments

In the above-described exemplary embodiments, the inside housing 81 is made to rotate relative to the outside housing 82. Instead, the outside housing 82 may be made to rotate relative to the inside housing 81. Specifically, when the outside housing 82 rotates between the opening position and the closing position and the outside housing 82 is located at the opening position, the inside passage holes 89 are opposed to the outside passage holes 102 and are opened. In contrast, when the outside housing 82 is located at the closing position, the inside passage holes 89 are closed by portions of the outside circumferential wall 97 other than the outside passage holes 102.

(4) Fourth Modification to the Exemplary Embodiments

Figures 10A, 10B:
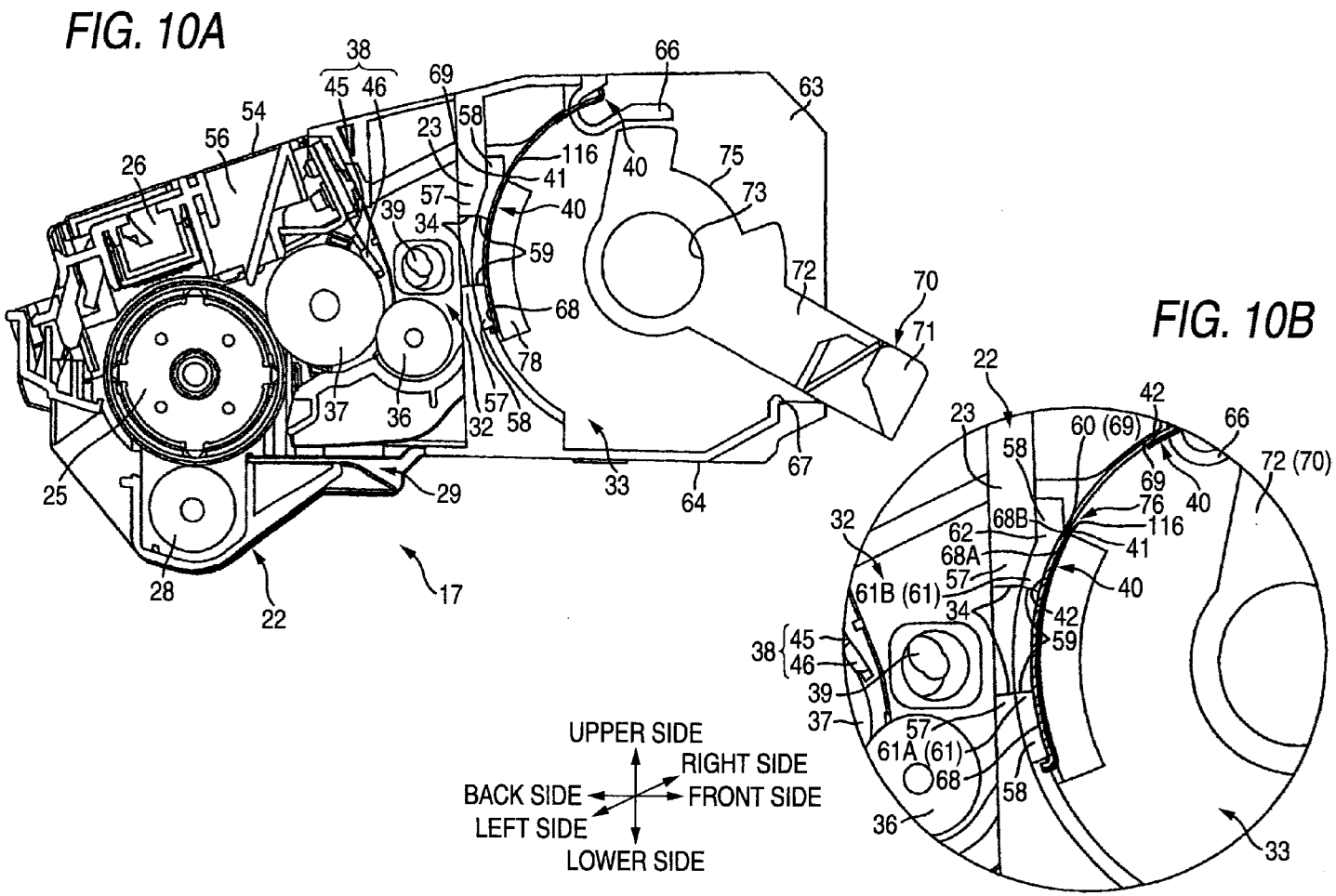
FIGS. 10A and 10B are diagrams showing a fourth modification to the exemplary embodiments applied to FIGS. 3A and 3B.

FIGS. 10A and 10B are diagrams showing a fourth modification to the exemplary embodiments applied to FIGS. 3A and 3B.

In the above-described exemplary embodiments, as shown in FIG. 3B, the bonding faces 42 of the sheets 40 to the shutter 68 are bonded to the portions of the shutter 68 below the shutter openings 69. That is, since the sheets 40 are partially bonded to the front side surface of the shutter 68, stepped portions 115 are formed on the front side surface of the shutter 68 by the circumferential edges of the sheets 40. Accordingly, the developer may stay in the stepped portions 115, thereby contaminating the shutter 68 with the developer. Accordingly, as shown in FIGS. 10A and 10B, the shape of the sheets 40 can be made to be substantially equal to the shape of the front side surface (see FIG. 5) of the shutter 68. That is, the bonding faces 42 of the sheets 40 may have a shape bonded to substantially the entire front side surface of the shutter 68.

Accordingly, it is possible to prevent the stepped portions 115 from being formed on the front side surface of the shutter 68 by the sheets 40. As a result, it is possible to prevent the developer from staying in the stepped portions 115 to contaminate the shutter 68. Since the bonding faces 42 of the sheets 40 are bonded substantially to the entire front side surface of the shutter 68, the sheets 40 can be relatively strongly bonded to the shutter 68.

Inclined surfaces 116 shown in FIG. 10B may be formed in the sheets 40. The inclined surfaces 116 are formed in the upper ends of the sheets 40 and are inclined downward to the rear side. Accordingly, even when the developer is attached to the upper ends of the sheets 40, the developer is guided to the rear side (to the developing part 32) by the inclined surfaces 116, thereby preventing the developer from overflowing the cartridge housing part 33 and dropping in the front thereof.

(5) Fifth Modification to the Exemplary Embodiments

Figure 11A:
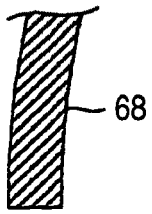
FIGS. 11A and 11B show a protruding portion according to a fifth modification to the exemplary embodiments, where
Figure 11A:
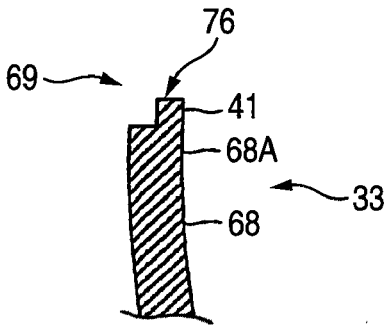
Figure 11B:
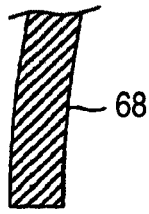
Figure 11B:
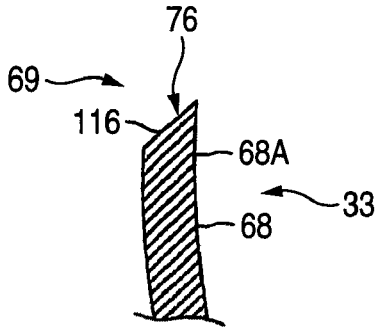
Figure 11B:
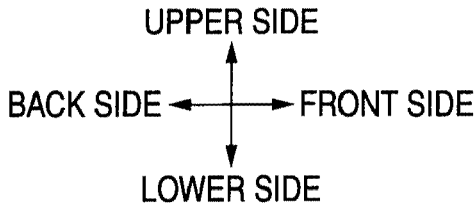

FIGS. 11A and 11B show a protruding portion according to a fifth modification to the exemplary embodiments, where FIG. 11A shows a first aspect thereof and FIG. 11B shows a second aspect thereof.

In the above-described exemplary embodiments, the protruding portions 76 are formed by the damming portions 41 of the sheets 40 and the lower circumferential edges 68A of the shutter 68 (see FIG. 3B). Instead, as shown in FIGS. 11A and 11B, the protruding portions 76 may be formed by only the lower circumferential edges 68A of the shutter 68, and the front ends (close to the cartridge housing part 33) of the protruding portions 76 may be made to protrude upward more than the rear ends thereof.

In this case, for example, in the protruding portions 76 shown in FIG. 11A, the front ends of the lower circumferential edges 68A are made to protrude upward more than the rear ends by one step.

The protruding portions 76 shown in FIG. 11B are provided with the above-mentioned inclined surfaces 116. In this case, the front ends of the protruding portions 76 are made to protrude upward more than the rear ends thereof and the inclined surfaces 116 are inclined downward from the front ends to the rear ends.

Accordingly, the developer is hardly attached to the inclined surfaces 116. Even when the developer is attached to the inclined surfaces 116, the developer is guided from the front side to the rear side by the inclined surfaces 116, thereby preventing the developer from overflowing the cartridge housing part 33 to fly.

(6) Sixth Modification to the Exemplary Embodiments

Figure 12:
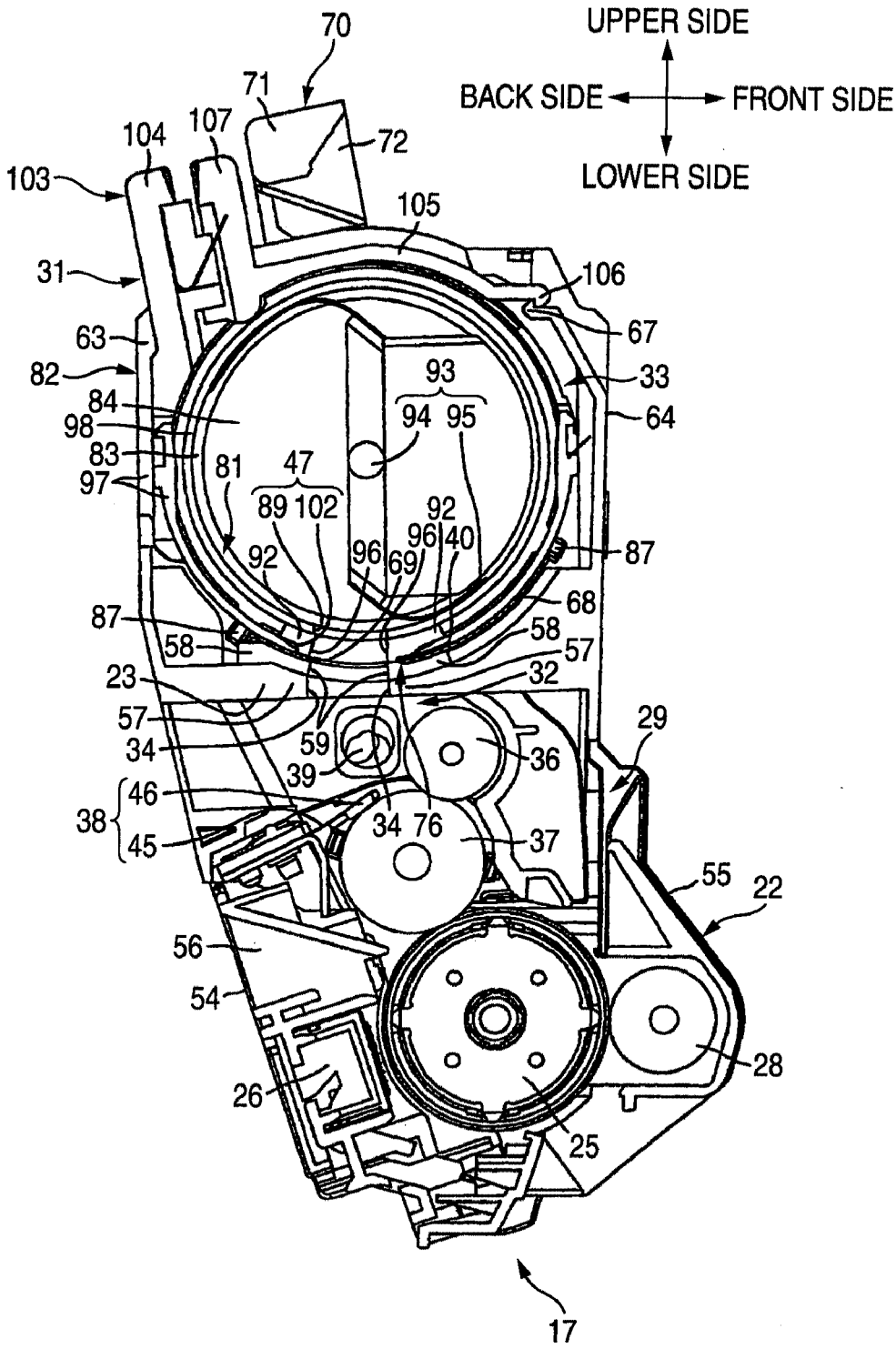
FIG. 12 is a left side sectional view of a process cartridge according to a sixth modification to the exemplary embodiments.

FIG. 12 is a left side sectional view showing a process cartridge according to a sixth modification to the exemplary embodiments.

In the process cartridge 17 according to the above-described exemplary embodiments, as shown in FIG. 2A, when the shutter 68 is located at the opening position, the cartridge-side passage holes 47, the frame-side passage holes 34, and the shutter openings 69 are arranged substantially in the horizontal direction. Instead, for example, when the shutter 68 is located at the opening position as shown in FIG. 12, the cartridge-side passage holes 47, the invention can be applied to the process cartridge 17 in which the frame-side passage holes 34, and the shutter openings 69 are arranged substantially in the vertical direction. In this case, the shutter 68 moves substantially in the horizontal direction (front-rear direction) (the shutter 68 closes the frame-side passage holes 34 by moving to the rear side in FIG. 12).

In this case, when the shutter 68 moves to the rear side, the shutter openings 69 cross the movement path of the developer (path extending vertically between the cartridge-side passage holes 47 and the frame-side passage holes 34) and thus the developer may be attached to the front ends of the shutter openings 69. However, by disposing the protruding portions 76 on the front end portions in the horizontal direction of the shutter openings 69 opposed to the cartridge-side passage holes 47, the developer attached to the end portions are blocked from the cartridge-side passage holes 47 by the protruding portions 76, thereby preventing the developer from flying from the cartridge housing part 33.

(7) Seventh Modification to the Exemplary Embodiments

Figures 13A, 13B:
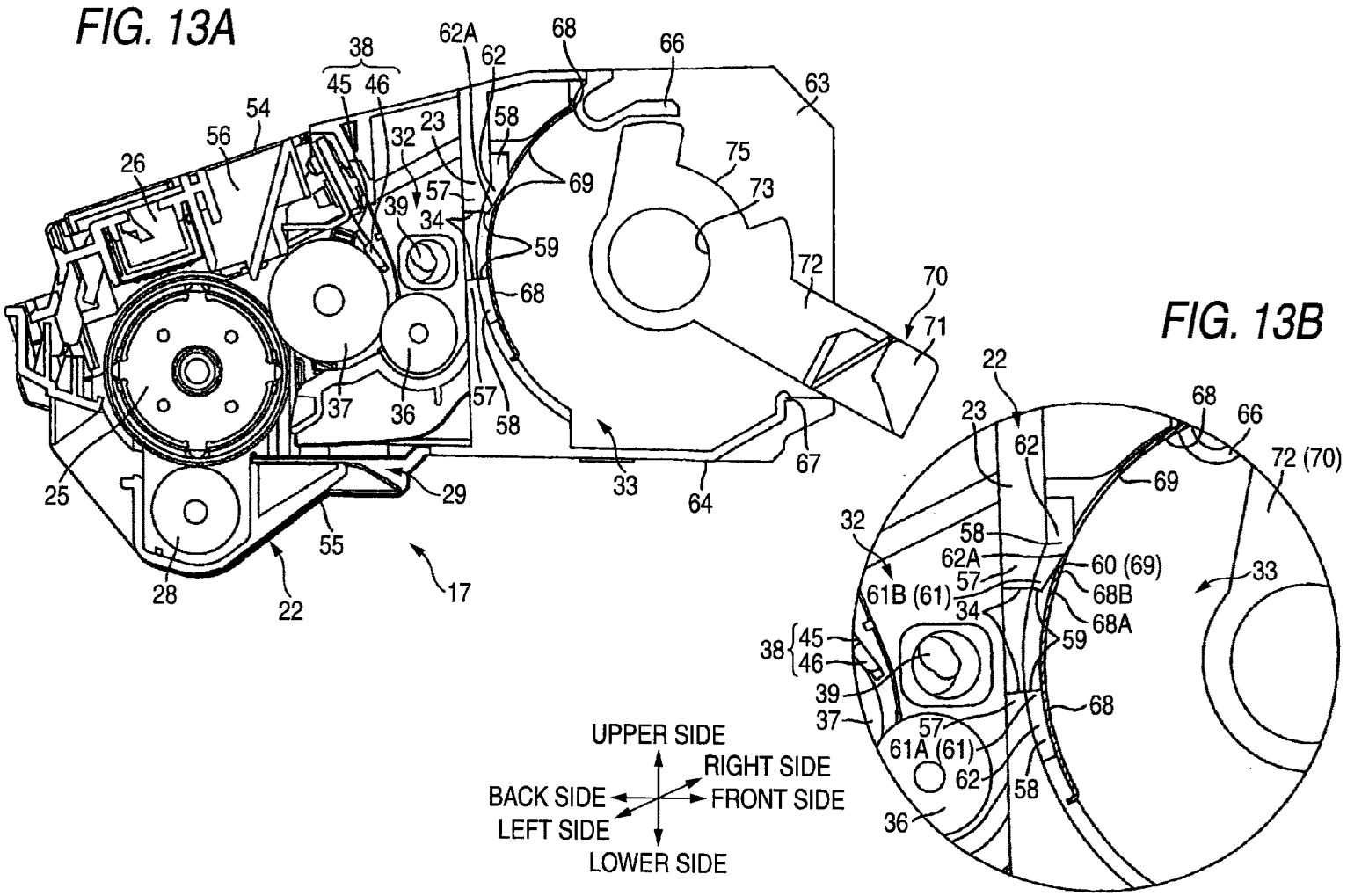
FIGS. 13A and 13B are diagrams showing a first aspect of a seventh modification to the exemplary embodiments applied to FIGS. 3A and 3B.
Figures 14A, 14B:
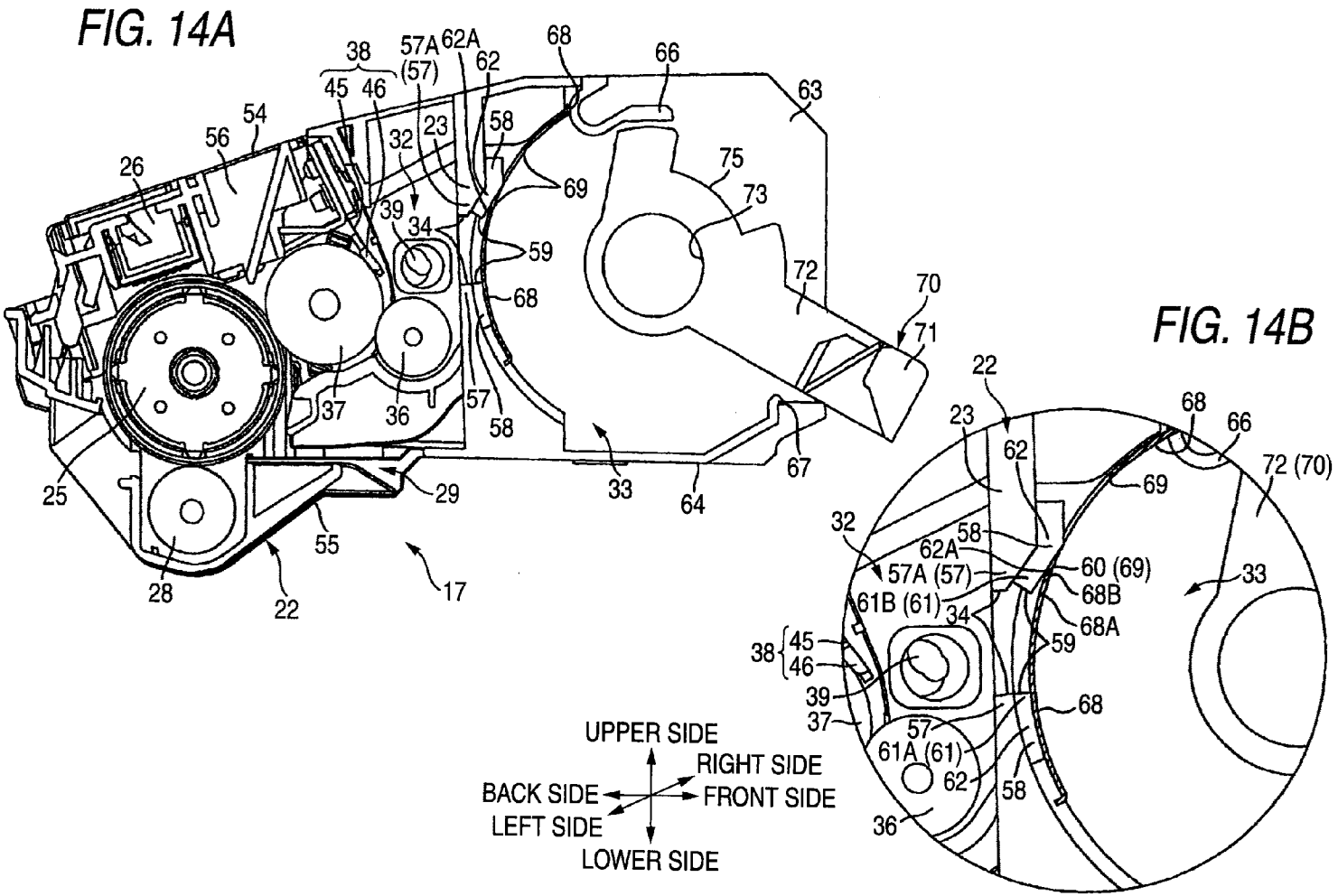
FIGS. 14A and 14B are diagrams showing a second aspect of the seventh modification applied to FIGS. 3A and 3B.
Figures 15A, 15B:
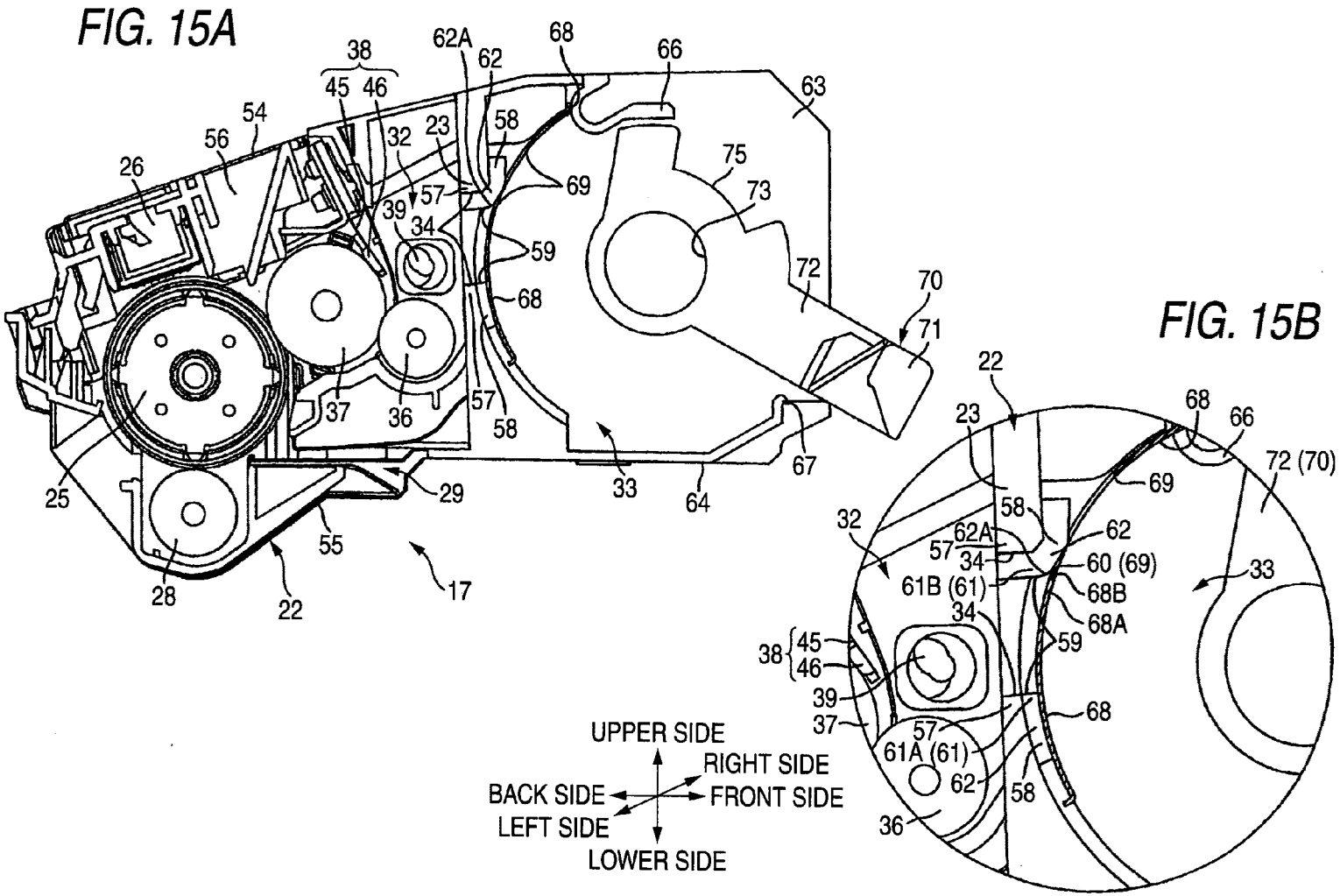
FIGS. 15A and 15B are diagrams showing a third aspect of the seventh modification applied to FIGS. 3A and 3B.
Figures 16A, 16B:
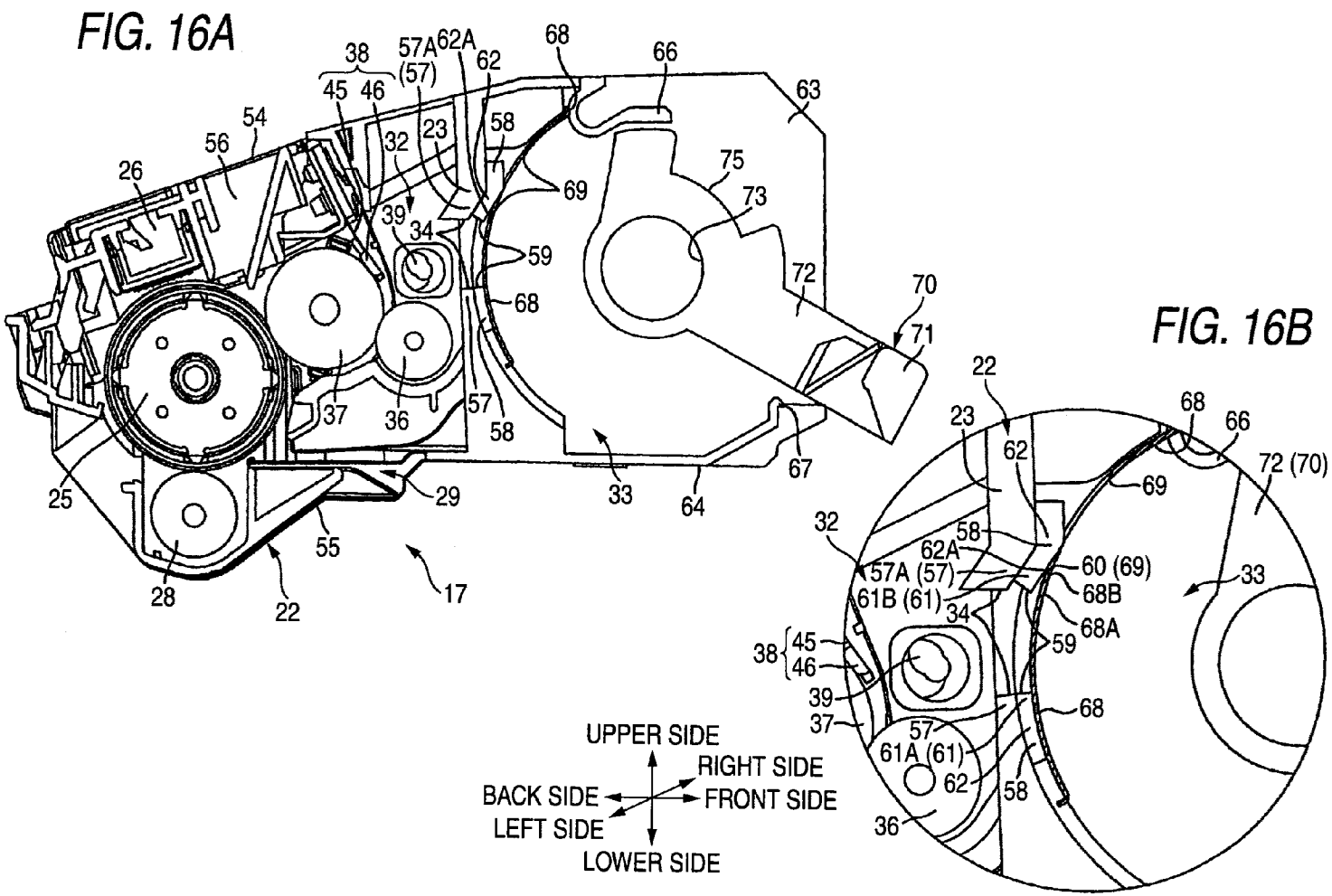
FIGS. 16A and 16B are diagrams showing a fourth aspect of the seventh modification applied to FIGS. 3A and 3B.

FIGS. 13A and 13B are diagrams showing a first aspect of a seventh modification to the exemplary embodiments applied to FIGS. 3A and 3B. FIGS. 14A and 14B are diagrams showing a second aspect of the seventh modification applied to FIGS. 3A and 3B. FIGS. 15A and 15B are diagrams showing a third aspect of the seventh modification applied to FIGS. 3A and 3B. FIGS. 16A and 16B are diagrams showing a fourth aspect of the seventh modification applied to FIGS. 3A and 3B. In FIGS. 13A to 16B, the sheets 40 and the shutter guide portions 78 shown in FIGS. 3A and 3B are omitted.

In the seventh modification, as shown in FIG. 13B, inclined surfaces 62A as an example of the contact surface are formed in the portions (referred to as upper portions 62) of the frame seals 58 above the cutout portions 59. The inclined surfaces 62A form the front side surfaces below the upper portions 62 and extend to be inclined obliquely to the rear-down side (that is, toward the frame-side passage holes 34). Here, in the first aspect, by setting the thickness (size in the front-rear direction) of the upper portions 62 of the frame seals 58 to decrease toward the frame-side passage holes 34 as it goes down, the inclined surfaces 62A are formed.

Here, when the shutter 68 is located at the opening position, the inclined surfaces 62A face the upper ends 68B as the lower ends of the shutter openings 69 of the shutter 68 from the upside. Accordingly, when the shutter 68 moves upward from the opening position to the closing position, the inclined surfaces 62A come in contact with the upper ends 68B. At this time, the developer attached to the upper ends 68B moves to and from the inclined surfaces 62A. Accordingly, it is possible to remove the developer from the upper ends 68B of the shutter 68 until the shutter 68 moves to the closing position. As a result, when the shutter 68 is made to move to the closing position and then the developer cartridge 31 is detached from the cartridge housing part 33, it is possible to prevent the developer from overflowing the cartridge housing part 33 to fly from the upper ends 68B of the shutter 68.

As described above, the inclined surfaces 62A extend to be inclined obliquely to the rear downside, and in other words, extend obliquely to the front upside. Accordingly, the contact pressure of the inclined surfaces 62A with the upper ends 68B slowly increases as the shutter 68 moves upward from the opening position to the closing position. As a result, it is possible to prevent the developer attached to the upper ends 68B from being pushed and overflowing the cartridge housing part 33 due to the sudden contact of the inclined surfaces 62A with the upper ends 68B of the shutter 68.

In this way, by setting the thickness of the frame seals 58 (upper portions 62) in the inclined surfaces 62A to decrease to the frame-side passage holes 34 as it goes down, the contact pressure of the inclined surfaces 62A with the upper ends 68B can be made to increase as the shutter 68 moves from the opening position to the closing position.

In a second aspect, as shown in FIGS. 14A and 14B, the thickness of portions (referred to as supporting portions 57A) of the curved portion 57 of the partition wall 23 supporting the portions of the frame seals 58 corresponding to the inclined surfaces 62A is made to decrease to the frame-side passage holes 34 as it goes down. In this case, even when the thickness of the upper portions 62 of the frame seals 58 is not made to decrease unlike the first aspect, the upper portions 62 are deviated to the frame-side passage holes 34 along the supporting portions 57A having a decreasing thickness. Accordingly, the inclined surfaces 62A can be formed, thereby enhancing the contact pressure of the inclined surfaces 62A with the upper ends 68B as the shutter 68 moves from the opening position to the closing position.

Here, as shown in FIG. 2B, when the shutter 68 is located at the opening position, the portions of the shutter 68 above the shutter openings 69 are disposed between the upper circumferential edges 110B of the developer seals 92 and the upper circumferential edges 61B of the frame seals 58. Accordingly, even when the thickness of the upper portions 62 of the frame seals 58 is made to decrease (see FIGS. 13A and 13B) or the thickness of the supporting portions 57A of the process frame 22 is made to decrease (see FIGS. 14A and 14B), the decreased thickness can be compensated for by the thickness of the shutter 68 above the shutter openings 69. Accordingly, the formation of unnecessary gaps can be prevented, thereby preventing the leakage of developer.

Instead of setting the thickness of the supporting portions 57A to decrease toward the frame-side passage holes 34 as it goes down (see FIGS. 14A and 14B), it can be considered that the supporting portions 57A can be inclined toward the frame-side passage holes 34 (developing part 32) (that is, obliquely to the rear downside) without reducing the thickness as it goes down as shown in FIGS. 16A and 16B as the fourth aspect. In this case, the inclined surfaces 62A can be formed and thus the contact pressure of the inclined surfaces 62A with the upper ends 68B can be made to increase as the shutter 68 moves from the opening position to the closing position.

As shown in FIGS. 15A and 15B as the third aspect, the upper portions 62 of the frame seals 58 are made to extend to the frame-side passage holes 34 and are disposed on the upper circumferential edges of the frame-side passage holes 34, so that the inclined surfaces 62A extend to the inside (the upper circumferential edges) of the frame-side passage holes 34. Accordingly, the inclined surfaces 62A inclined obliquely to the rear downside in a curved shape are naturally formed in the upper portion 62 around the front corners in the curved portion 57 of the partition wall 23 forming the upper circumferential edges of the frame-side passage holes 34.

Accordingly, even when the thickness of the upper portions 62 of the frame seals 58 is not made to decrease and even when the thickness of the process frames 22 is not made to decrease, the contact pressure of the inclined surfaces 62A with the upper ends 68B of shutter openings 69 of the shutter 68 can be made to increase as the shutter 68 moves from the opening position to the closing position.

According to another aspect of the invention, the second elastic member comprises a contact surface formed in a portion downstream of the second through hole in the movement direction, the contact surface extends to the second opening, and the contact surface is contactable with the upstream end of the third opening of the shutter moving from the opening position to the closing position at a contact pressure that increases as the shutter moves from the opening position to the closing position.

According thereto, the contact surface formed more downstream in the movement direction than the second through hole of the second elastic member comes in contact with the upstream end of the third opening of the shutter moving from the opening position to the closing position. At this time, the developer attached to the upstream end of the third opening of the shutter moves to and from the contact surface. Accordingly, it is possible to remove the developer from the upstream end of the third opening of the shutter until the shutter move to the closing position. As a result, when the shutter is made to move to the closing position and then the developer cartridge is detached from the cartridge housing part, it is possible to prevent the developer from overflowing the cartridge housing part to fly from the upstream end of the third opening of the shutter.

The contact pressure of the contact surface with the upstream end of the third opening of the shutter becomes greater as the shutter moves from the opening position to the closing position. Accordingly, it is possible to prevent the developer attached to the upstream end from being pushed out and overflowing the cartridge housing part due to the sudden contact of the contact surface with the upstream end of the third opening of the shutter.

According to still another aspect of the invention, a thickness of the second elastic member corresponding to the contact surface decreases as approaching toward the second opening upstream in the movement direction.

According thereto, by allowing the thickness of the second elastic member in the contact surface to decrease toward the second opening as it goes upstream in the movement direction, it is possible to enhance the contact pressure of the contact surface with the upstream end of the third opening of the shutter as the shutter moves from the opening position to the closing position.

According to still another aspect of the invention, thickness of the housing corresponding to the contact surface of the second elastic member decreases as approaching toward the second opening upstream in the movement direction.

According thereto, by reducing the thickness of the portion of the housing supporting the portion of the second elastic member corresponding to the contact surface toward the second opening as it goes upstream in the movement direction, it is possible to enhance the contact pressure of the contact surface with the upstream end of the third opening of the shutter as the shutter moves from the opening position to the closing position.

According to still another aspect of the invention, the housing corresponding to the contact surface of the second elastic member is inclined as approaching toward the second opening upstream in the movement direction.

According thereto, by inclining the portion of the housing supporting the portion of the second elastic member corresponding to the contact surface toward the second opening as it goes upstream in the movement direction, it is possible to enhance the contact pressure of the contact surface with the upstream end of the third opening of the shutter as the shutter moves from the opening position to the closing position.

According to still another aspect of the invention, when the shutter is located at the opening position, a portion of the shutter downstream in the movement direction from the third opening is disposed between a portion of the first elastic member downstream in the movement direction from the first through hole and a portion of the second elastic member downstream in the movement direction from the second through hole.

According thereto, when the shutter is located at the opening position, the portion of the shutter downstream in the movement direction from the third opening is disposed between a portion of the first elastic member downstream in the movement direction from the first through hole and a portion of the second elastic member downstream in the movement direction from the second through hole. Accordingly, even when the thickness of the portion of the second elastic member downstream in the movement direction from the second through hole is made to decrease, or even when the thickness of the housing is made to decrease, the decreasing thickness can be compensated for the thickness of the portion of the shutter downstream in the movement direction from the third opening. As a result, it is possible to prevent the formation of an unnecessary gap, thereby preventing the leaking of the developer.

According to still another aspect of the invention, the contact surface extends into the second opening.

According thereto, even when the thickness of the second elastic member is not made to decrease and the thickness of the housing is not made to decrease, it is possible to enhance the contact pressure of the contact surface with the upstream end of the third opening of the shutter as the shutter moves from the opening position to the closing position, by allowing the contact surface to extend to the inside of the second opening.

According to still another aspect of the invention, the shutter comprises a protruding portion provided at an upstream end portion of the third opening in the movement direction, and the protruding portion comprises a first end at a side close to the first opening and a second end at a side close to the second opening, the first end protruding more downstream in the movement direction than the second end.

According thereto, the protruding portion is formed in the upstream end of the third opening of the shutter and an end of the protruding portion close to the first opening (close to the cartridge housing part) as an example of the first end protrudes more downstream in the movement direction than an end close to the second opening (more apart from the cartridge housing part than the first opening) as an example of the second end. Accordingly, even when the developer is attached to the upstream end of the third opening, the developer is blocked from the first opening side by the protruding portion, thereby preventing the developer from overflowing the cartridge housing part to fly.

According to still another aspect of the invention, the protruding portion comprises an inclined surface that is inclined downstream in the movement direction as approaching from the second end toward the first end.

According thereto, the inclined surface included in the protruding portion is inclined from downstream to upstream in the movement direction as it goes from the end of the protruding portion close to the first opening to the end close to the second opening. Accordingly, the developer is hardly attached to the inclined surface. In addition, even when the developer is attached to the inclined surface, the developer is guided from the first opening to the second opening by the inclined surface, thereby preventing the developer from overflowing the cartridge housing part to fly.

According to still another aspect of the invention, the protruding portion comprises a flexible sheet protruding into the third opening from the upstream end portion of the third opening in the moving direction at the side close to the first opening.

According thereto, the sheet included in the protruding portion protrudes into the third opening from the portion of the lower end portion of the third opening of the shutter close to the first opening, and the developer attached to the lower end portion of the third opening is thus blocked from the first opening side, thereby preventing the developer from overflowing the cartridge housing part to fly.

Since the sheet is flexible, the sheet can be closely attached to the shutter having a curved shape. Accordingly, the sheet can block the developer attached to the lower end portion of the third opening from the first opening side without any gap.

According to still another aspect of the invention, the protruding portion comprises a flexible sheet protruding into the third opening from the upstream end portion of the third opening in the moving direction at the side close to the first opening.

According thereto, by bonding the bonding surface of the sheet to the portion of the shutter below the third opening, it is possible to easily bond the sheet to the shutter.

According to still another aspect of the invention, the sheet comprises a bonding surface bonded to a portion of the shutter upstream of the third opening in the moving direction.

According thereto, since the bonding surface of the sheet is bonded to substantially the entire surface of the shutter close to the first opening, it is possible to prevent a stepped portion from being formed on the surface of the shutter close to the first opening by the sheet. Accordingly, it is possible to prevent the developer from staying in the stepped portion to contaminate the shutter.

According to still another aspect of the invention, the sheet comprises a bonding surface bonded to substantially entire surface of the shutter facing the first opening.

According thereto, since the bonding surface of the shutter is boned to substantially the entire surface of the shutter close to the first opening, it is possible to relatively strongly bond the sheet to the shutter.

According to still another aspect of the invention, when the shutter is located at the opening position, the first opening, the second opening, and the third opening are arranged in a substantially horizontal direction, and the movement direction is upward.

According thereto, when the shutter is located at the opening position, the first opening, the second opening, and the third opening are arranged substantially in the horizontal direction and the movement direction is upward. Accordingly, the developer may be attached to the lower end portion of the third opening which is the upstream end in the movement direction.

However, since the protruding portion is formed in the lower end portion of the third opening, the developer attached to the lower end portion of the third opening is b locked from the first opening side by the protruding portion, thereby preventing the developer from overflowing the cartridge housing part to fly.

According to still another aspect of the invention, when the shutter is located at the opening position, the first opening, the second opening, and the third opening are arranged in a substantially vertical direction, and the movement direction is a substantially horizontal direction.

According thereto, when the shutter is located at the opening position, the first opening, the second opening, and the third opening are arranged substantially in the vertical direction, and the movement direction is substantially equal to the horizontal direction. Accordingly, the developer may be attached to the end of the third opening in the horizontal direction.

However, since the protruding portion is formed in the end portion of the third opening in the horizontal direction, the developer attached to the end portion is blocked from the first opening side by the protruding portion, thereby preventing the developer from overflowing the cartridge housing part to fly.

What is claimed is:

1. A developing unit comprising:

a developer cartridge that is configured to accommodate developer and comprises a first opening for enabling communication between an inside of the developer cartridge and an outside of the developer cartridge;

a first elastic member that comprises a first through hole and protrudes outward from the developer cartridge, the first through hole surrounding the first opening;

a housing comprising:

a cartridge housing part for housing the developer cartridge, wherein the cartridge housing part includes a shutter; and a second opening that is provided in a position opposite to the first opening and is formed toward the cartridge housing part; and a second elastic member which protrudes from the housing toward the cartridge housing part, which is contactable with the first elastic member, and which comprises a second through hole surrounding the second opening;

wherein the shutter comprises a third opening and is movable between an opening position where the third opening is located at a position between the first opening and the second opening and a closing position where the third opening is located at a position different from the opening position between the first opening and the second opening, wherein when the shutter is located at the opening position, an upstream end of the third opening in a movement direction of the shutter from the opening position to the closing position is located more upstream than upstream ends of the first through hole and the second through hole in the movement direction, wherein the shutter comprises a protruding portion provided at an upstream end portion of the third opening in the movement direction, wherein the protruding portion comprises a first end at a side close to the first opening and a second end at a side close to the second opening, the first end protruding more downstream in the movement direction than the second end, and wherein the first end of the protruding portion of the shutter is configured to selectively engage both the first elastic member and the second elastic member.

2. The developing unit according to claim 1, wherein the second elastic member comprises a contact surface formed in a portion downstream of the second through hole in the movement direction, wherein the contact surface extends to the second opening, and wherein the contact surface is contactable with the upstream end of the third opening of the shutter moving from the opening position to the closing position at a contact pressure that increases as the shutter moves from the opening position to the closing position.

3. The developing unit according to claim 2, wherein a thickness of the second elastic member corresponding to the contact surface decreases as approaching toward the second opening upstream in the movement direction.

4. The developing unit according to claim 2, wherein a thickness of the housing corresponding to the contact surface of the second elastic member decreases as approaching toward the second opening upstream in the movement direction.

5. The developing unit according to claim 2, wherein the housing corresponding to the contact surface of the second elastic member is inclined as approaching toward the second opening upstream in the movement direction.

6. The developing unit according to claim 3, wherein when the shutter is located at the opening position, a portion of the shutter downstream in the movement direction from the third opening is disposed between a portion of the first elastic member downstream in the movement direction from the first through hole and a portion of the second elastic member downstream in the movement direction from the second through hole.

7. The developing unit according to claim 4, wherein when the shutter is located at the opening position, a portion of the shutter downstream in the movement direction from the third opening is disposed between a portion of the first elastic member downstream in the movement direction from the first through hole and a portion of the second elastic member downstream in the movement direction from the second through hole.

8. The developing unit according to claim 2, wherein the contact surface extends into the second opening.

9. The developing unit according to claim 1, wherein the protruding portion comprises an inclined surface that is inclined downstream in the movement direction as approaching from the second end toward the first end.

10. The developing unit according to claim 1, wherein the protruding portion comprises a flexible sheet protruding into the third opening from the upstream end portion of the third opening in the moving direction at the side close to the first opening.

11. The developing unit according to claim 10, wherein the sheet comprises a bonding surface bonded to a portion of the shutter upstream of the third opening in the moving direction.

12. The developing unit according to claim 10, wherein the sheet comprises a bonding surface bonded to substantially entire surface of the shutter facing the first opening.

13. The developing unit according to claim 1, wherein when the shutter is located at the opening position, the first opening, the second opening, and the third opening are arranged in a substantially horizontal direction, and wherein the movement direction is upward.

14. The developing unit according to claim 1, wherein when the shutter is located at the opening position, the first opening, the second opening, and the third opening are arranged in a substantially vertical direction, and wherein the movement direction is a substantially horizontal direction.

* * * * *